US009081318B2

(12) United States Patent
Suwa et al.

(10) Patent No.: US 9,081,318 B2
(45) Date of Patent: Jul. 14, 2015

(54) FERRITE CARRIER CORE MATERIAL AND FERRITE CARRIER FOR ELECTROPHOTOGRAPHIC DEVELOPER, METHODS FOR MANUFACTURING THESE, AND ELECTROGRAPHIC DEVELOPER USING THE FERRITE CARRIER

(75) Inventors: Tomoyuki Suwa, Ibaraki (JP); Toru Iwata, Saitama (JP); Koji Aga, Chiba (JP)

(73) Assignee: POWDERTECH CO., LTD., Chiba (JP)

( * ) Notice: Subject to any disclaimer, the term of this patent is extended or adjusted under 35 U.S.C. 154(b) by 189 days.

(21) Appl. No.: 13/823,250

(22) PCT Filed: Aug. 29, 2011

(86) PCT No.: PCT/JP2011/069435
§ 371 (c)(1),
(2), (4) Date: Mar. 14, 2013

(87) PCT Pub. No.: WO2012/105078
PCT Pub. Date: Aug. 9, 2012

(65) Prior Publication Data

US 2013/0171558 A1 Jul. 4, 2013

(30) Foreign Application Priority Data

Jan. 31, 2011 (JP) ..... 2011-018587

(51) Int. Cl.
*G03G 9/113* (2006.01)
*G03G 9/107* (2006.01)

(52) U.S. Cl.
CPC ..... *G03G 9/1136* (2013.01); *G03G 9/107* (2013.01); *G03G 9/1075* (2013.01); *G03G 9/113* (2013.01)

(58) Field of Classification Search
CPC ..... G03G 9/107; G03G 9/1075; G03G 9/113; G03G 9/1136
USPC ..... 430/111.33, 111.31, 111.32, 111.41, 430/137.1, 137.13; 423/594.2; 252/62.63
See application file for complete search history.

(56) References Cited

U.S. PATENT DOCUMENTS

| | | | |
|---|---|---|---|
| 5,595,850 | A | 1/1997 | Honjo et al. |
| 7,964,330 | B2 | 6/2011 | Shinmura et al. |
| 2007/0231732 | A1 | 10/2007 | Shinmura et al. |
| 2010/0055601 | A1 | 3/2010 | Sugiura et al. |
| 2010/0196818 | A1 | 8/2010 | Kojima et al. |

FOREIGN PATENT DOCUMENTS

| | | | |
|---|---|---|---|
| JP | 08-022150 | | 1/1996 |
| JP | 2004-004648 | | 1/2004 |
| JP | 2007-271662 | | 10/2007 |
| JP | 2008-096977 | | 4/2008 |
| JP | 2010-039368 | | 2/2010 |
| JP | 2010-055014 | | 3/2010 |
| JP | 2010-181524 | A | 8/2010 |
| JP | 2010-181525 | A | 8/2010 |
| JP | 2010-243798 | * | 10/2010 |
| JP | 2010-243798 | A | 10/2010 |

OTHER PUBLICATIONS

AIPN Japanese Patent Office machine-assisted translation of JP 2010-243798 (published Oct. 2010).*
U.S. Appl. No. 13/738,324 to Koji Aga et al., which was filed on Jan. 10, 2013.
International Search Report for International Application No. PCT/JP2011/069435, mailed on Oct. 11, 2011; and an English translation thereof.
Written Opinion of the International Searching Authority (WO/ISA) for International Application No. PCT/JP2011/069435, mailed on Oct. 11, 2011, (in the Japanese language).

* cited by examiner

*Primary Examiner* — Janis L Dote
(74) *Attorney, Agent, or Firm* — Greenblum & Bernstein, P.L.C.

(57) ABSTRACT

It is an object of the present invention to provide a ferrite carrier core material and a ferrite carrier for an electrophotographic developer, which have an excellent charging property, hardly cause carrier scattering due to cracking and chipping of the core material, and have a prolonged life, and methods for manufacturing these, and an electrophotographic developer using the ferrite carrier. For this object, the ferrite carrier core material and a ferrite carrier for an electrophotographic developer, wherein (1) the ferrite composition contains 0.5 to 2.5% by weight of Sr, and the presence amount of Sr—Fe oxides satisfies a specific conditional expression, (2) the distribution in the number of the shape factor SF-2 is in a specific range, (3) the BET specific surface area is 0.15 to 0.30 $m^2/g$, (4) the average particle diameter $D_{50}$ is 20 to 35 μm, and (5) the magnetization is 50 to 65 $Am^2/kg$.

12 Claims, No Drawings

FERRITE CARRIER CORE MATERIAL AND FERRITE CARRIER FOR ELECTROPHOTOGRAPHIC DEVELOPER, METHODS FOR MANUFACTURING THESE, AND ELECTROGRAPHIC DEVELOPER USING THE FERRITE CARRIER

TECHNICAL FIELD

The present invention relates to a ferrite carrier core material and a ferrite carrier used for a two-component electrophotographic developer used in copying machines, printers and the like, methods for manufacturing these, and an electrophotographic developer using the ferrite carrier.

BACKGROUND ART

The method of electrophotographic development is a method in which toner particles in a developer are made to adhere on an electrostatic latent image formed on a photoreceptor to develop the image. The developer used in this method is classified into a two-component developer composed of toner particles and carrier particles, and a one-component developer using toner particles alone.

As a development method using a two-component developer composed of toner particles and carrier particles among those developers, a cascade method and the like were formerly employed, but a magnetic brush method using a magnet roll is now in the mainstream.

In a two-component developer, a carrier particle is a carrier substance which is stirred with a toner particle in a development box filled with the developer to thereby impart a desired charge to the toner particle, and further transports the charged toner particle to a surface of a photoreceptor to thereby form a toner image on the photoreceptor. The carrier particle remaining on a development roll holding a magnet is again returned from the development roll to the development box, mixed and stirred with a fresh toner particle, and used repeatedly in a definite period.

In a two-component developer, unlike a one-component developer, a carrier particle has functions of being mixed and stirred with a toner particle to charge the toner particle and transporting the toner particle, and has good controllability on designing a developer. Therefore, the two-component developer is suitable for full-color development apparatuses requiring a high image quality, high-speed printing apparatuses requiring reliability and durability in image maintenance, and other apparatuses.

In a two-component developer thus used, it is needed that image characteristics, such as image density, fogging, white spots, gradation and resolving power, exhibit predetermined values from the initial stage, and additionally these characteristics do not vary and are stably maintained during endurance printing. In order to stably maintain these characteristics, properties of a carrier particle contained in a two-component developer need to be stable.

As a carrier particle forming a two-component developer, an iron powder carrier, such as an iron powder whose surface is covered with an oxide film, or an iron powder whose surface is coated with a resin, has conventionally been used. Since such an iron powder carrier has a high magnetization and a high conductivity as well, the carrier has an advantage of easily providing images well reproduced on the solid portion.

However, since such an iron powder carrier has a heavy true specific gravity of about 7.8 and a too high magnetization, stirring and mixing thereof with a toner particle in a development box is liable to generate fusion, so-called toner spent, of toner-constituting components onto the iron powder carrier surface. The generation of such toner spent decreases the effective carrier surface area, and is liable to reduce the triboelectric chargeability with the toner particle.

In a resin-coated iron powder carrier, the resin on the surface exfoliates due to stresses during endurance printing, and a core material (iron powder) having a high conductivity and a low dielectric breakdown voltage is thereby exposed, and leakage of the charge thereby occurs in some cases. Due to such leakage of the charge, an electrostatic latent image formed on a photoreceptor is broken, brush streaks and the like are generated on the solid portion, and a uniform image can hardly be obtained. For these reasons, iron powder carriers such as an oxide film-coated iron powder or a resin-coated iron powder have not been used recently.

In recent years, in place of iron powder carriers, a ferrite having a light true specific gravity of about 5.0 and a low magnetization is mainly used as a carrier, and a resin-coated ferrite carrier whose surface is coated with a resin is often used, whereby the life of the developer has been remarkably prolonged.

The method for manufacturing such a ferrite carrier generally involves mixing ferrite carrier raw materials in predetermined amounts, and thereafter calcining, pulverizing and granulating and then sintering the mixed material; and depending on conditions, the calcination may be omitted.

Meanwhile, the environmental regulation has recently become strict, and the use of metals such as Ni, Cu and Zn comes to be avoided and the use of metals adapted to the environmental regulation is demanded; then, ferrite compositions used as a carrier core material have been shifted from Cu—Zn ferrites and Ni—Zn ferrites to manganese ferrites, Mn—Mg—Sr ferrites and the like, which use Mn.

Patent Literature 1 (Japanese Patent Laid-Open No. 08-22150) describes a ferrite carrier in which a part of a manganese-magnesium ferrite is replaced by SrO. It is contended that when the ferrite carrier is used as a developer with a toner, by reducing a variation in magnetization among ferrite carrier particles, the developer exhibits excellences in image quality and durability, is friendly to the environment, has a prolonged life, and is excellent in environmental stability. However, the ferrite carrier described in Patent Literature 1 cannot satisfy simultaneously both a uniform surface property having a reasonable unevenness and a high charging capability. If the sintering temperature is made high, since the surface property exhibits much of smooth portions and becomes nonuniform, not only the distributions of the resistivity and the charge after resin coating are broadened, but also the strength to stirring stresses decreases. If the sintering temperature is made low, the surface apparently has a wrinkly uniform surface property, but since the value of the BET specific surface area becomes large, the charging property becomes low and the influence by environment becomes large.

Patent Literature 2 (Japanese Patent Laid-Open No. 2004-004648) describes a ferrite carrier having a spinel structure and having a volume-average particle diameter of 20 to 45 μm, which is a resin-coated carrier whose magnetization and surface uniformity are prescribed. In the core material particle described in Patent Literature 2, a high sintering temperature is used; the surface is smooth; and the coating resin hardly infiltrates; and the coating resin easily exfoliates; the achievement of the long life of the carrier is therefore difficult.

Carrier core materials using Mg are proposed as replacements of carrier core materials using Mn. For example, Patent Literature 3 (Japanese Patent Laid-Open No. 2010-39368)

describes a carrier core material containing magnesium, titanium and iron in definite proportions and having a BET specific surface area in a specific range. It is contended that the carrier core material provides a desired resistivity, a medium one or a high one, while exhibiting a high magnetization, and is excellent in the charging property, and has both of the surface property having a reasonable unevenness, and uniform shapes.

Since the carrier core material described in Patent Literature 3 has low contents of manganese and titanium, the material basically exhibits properties of a magnetite, and since the magnetization of a low magnetic field side is low, the occurrence of carrier beads carry over in image formation by an actual machine is apprehended.

There is Patent Literature 4 (Japanese Patent Laid-Open No. 2008-96977) in which since the particle diameter reduction of carriers has advanced in recent years along with the particle diameter reduction of toners involved in the image quality enhancement, the dispersion in particle shapes, which has not conventionally become a problem, is studied, and exfoliation of a resin, and uniform resin coating are studied.

Patent Literature 4 discloses a carrier prepared by coating the surface of a core particle composed of a ferrite containing at least a magnesium element, with a resin, and contends that the irregular shape factor of the core particle is 5% by number or less, and the grain diameter of the surface is 2 to 5 μm. Patent Literature 4 contends that the use of such a core particle imparts a sufficient charging property to a toner, and provides a stable charging property never causing image contamination such as fogging caused by toner scattering due to charge insufficiency.

However, Patent Literature 4 defines the shape of a core material particle only by an irregular shape factor of the core, and only pays attention especially to portions whose shape is remarkably poor, which is not enough in order to evaluate the dispersion of the particle shape as a whole, and to substitutionally evaluate carrier scattering and the like. Additionally, Patent Literature 4 carries out the improvement of the environmental dependency of a carrier only by resin coating. Therefore, even if the environmental dependency of the carrier right after the usage start in actual usage is good, a coating resin exfoliates as the usage time is prolonged, and the surface of the core particle is exposed to thereby lose the environmental dependency gradually; therefore, Patent Literature 4 is not enough from the viewpoint of the improvement of the environmental dependency.

Patent Literature 5 (Japanese Patent Laid-Open No. 2007-271662) describes a resin-coated ferrite carrier in which the apparent density, the average particle diameter and the BET specific surface area of a carrier core material have a definite relation. Since the core material particle described in Patent Literature 5 contains no Sr, not only unevenness is not formed, or hardly formed on the surface depending on the sintering temperature, but the addition of Sr cannot have an increasing effect on the charge of the core material.

In consideration of these conventional technologies, a ferrite carrier for an electrophotographic developer has been demanded which has the uniform particle shape and unevenness of the surface in spite of having a small particle diameter, has reasonable resistivity and magnetization, has an excellent charging property, and hardly causes carrier scattering.

DOCUMENT CITED

Patent Document

[Patent Document 1] Japanese Patent Laid-Open No. 8-22150

[Patent Document 2] Japanese Patent Laid-Open No. 2004-004648

[Patent Document 3] Japanese Patent Laid-Open No. 2010-39368

[Patent Document 4] Japanese Patent Laid-Open No. 2008-96977

[Patent Document 5] Japanese Patent Laid-Open No. 2007-271662

SUMMARY OF INVENTION

Problem to be Solved

Therefore, it is an object of the present invention to provide: a ferrite carrier core material and a ferrite carrier for an electrophotographic developer, wherein the core material particle has a larger BET specific surface area than conventional core material particles because having fine unevenness present on the surface although having a nearly spherical particle shape in spite of having a small particle diameter, has an excellent charging property, hardly causes carrier scattering due to cracking and chipping of the core material particle, and has a prolonged life; methods for manufacturing the ferrite carrier core material and the ferrite carrier; and an electrophotographic developer using the ferrite carrier.

Means to Solve the Invention

As a result of exhaustive studies to solve the above-mentioned problems, the present inventors have found that in a ferrite carrier core material (ferrite particle) containing a definite amount of Sr, the difference in particle diameter between particles having bad shapes and good shapes is small especially in the particle diameter below 35 μm in average particle diameter, and simple suppression of the presence of carrier particles having a small particle diameter cannot resolve the carrier scattering, but it is necessary for the distribution of the shape of particles in a collection of the particles being carriers to fall within a definite distribution width. That is, the present inventors have found that it is necessary for the distribution in the number of the shape factor SF-2 of a carrier core material to be a definite distribution, and have then found that such a ferrite carrier core material can be obtained by addition of a Sr compound after calcination. These findings have led to the present invention.

That is, the present invention provides a ferrite carrier core material for an electrophotographic developer, wherein:

(1) a ferrite composition contains 0.5 to 2.5% by weight of Sr; and the amount of existence of Sr—Fe oxides satisfies the following conditional expression:

$$0<\text{the weight of the Sr ferrite/the total weight of all Sr—Fe oxides}\leq 0.8 \quad \text{[Expression 1]}$$

provided that the total weight of all Sr—Fe oxides=the Sr ferrite+the Sr—Fe oxides other than the Sr ferrite;

(2) in the distribution in the number of the shape factor SF-2, the number of particles of 100 or more and less than 105 is 40% by number or more; that of 105 or more and less than 110 is 5 to 40% by number; that of 110 or more and less than 120 is 20% by number or less; that of 120 or more is 10% by number or less; and that of 130 or more is 5% by number or less;

(3) the BET specific surface area is 0.15 to 0.30 $m^2/g$;

(4) the average particle diameter $D_{50}$ in measurement by a laser diffraction type particle size distribution analyzer is 20 to 35 μm; and (5) the magnetization by VSM measurement when a magnetic field of $1K \cdot 1000/4\pi \cdot A/m$ is impressed is 50 to 65 $Am^2/kg$.

The ferrite carrier core material for an electrophotographic developer according to the present invention desirably contains 15 to 22% by weight of Mn, 0.5 to 3% by weight of Mg, and 45 to 55% by weight of Fe.

In the ferrite carrier core material for an electrophotographic developer according to the present invention, a surface oxide film is desirably formed.

In the ferrite carrier core material for an electrophotographic developer according to the present invention, $Mn^{3+}$ and/or $Mn^{4+}$ is desirably formed after the surface oxide film formation.

In the ferrite carrier core material for an electrophotographic developer according to the present invention, the Cl elution amount using a pH-4 standard solution is desirably 0.1 to 150 ppm.

In the ferrite carrier core material for an electrophotographic developer according to the present invention, the resistivity at 100 V at a 1-mm gap is desirably $1\times10^7$ to $5\times10^8\Omega$.

The present invention provides a ferrite carrier for an electrophotographic developer, wherein a surface of the ferrite carrier core material is coated with a resin.

The present invention further provides a method for manufacturing a ferrite carrier core material for an electrophotographic developer, the method comprising pulverizing, mixing and calcining a ferrite raw material, thereafter again pulverizing the calcined material, adding a Sr compound to the pulverized material, mixing and granulating the material, and primarily sintering the obtained granulated material at 600 to 800° C., thereafter regularly sintering the sintered material under an atmosphere of an oxygen concentration of 0.1 to 5% by volume at 1,100 to 1,200° C., and then deagglomerating and classifying the sintered material.

In the method for manufacturing a ferrite carrier core material for an electrophotographic developer according to the present invention, the ferrite raw material desirably contains a Mn compound and a Mg compound in addition to an Fe compound.

In the method for manufacturing a ferrite carrier core material for an electrophotographic developer according to the present invention, after the deagglomeration and classification, a surface oxidizing treatment is desirably carried out.

The present invention further provides a method for manufacturing a ferrite carrier for an electrophotographic developer, the method comprising coating a surface of the ferrite carrier core material obtained by the manufacturing method described above, with a resin.

The present invention provides an electrophotographic developer comprising the ferrite carrier and a toner.

The electrophotographic developer according to the present invention is used for a refill developer.

Advantageous Effects of Invention

The ferrite carrier core material for an electrophotographic developer according to the present invention is a ferrite carrier core material for an electrophotographic developer wherein the core material has a larger BET specific surface area than conventional core materials because having fine unevenness present on the surface although having a nearly spherical particle shape in spite of having a small particle diameter, has an excellent charging property, hardly causes carrier scattering due to cracking and chipping of the core material, and has a prolonged life. Then, the electrophotographic developer comprising a toner and a ferrite carrier prepared by coating the ferrite carrier core material with a resin has a large charge amount, prevents the carrier scattering in actual machines, and can continuously provide high-image quality printed matters. The manufacturing methods according to the present invention can provide the ferrite carrier core material and the ferrite carrier stably and productively.

DESCRIPTION OF EMBODIMENTS

Hereinafter, embodiments according to the present invention will be described.

<The Ferrite Carrier Core Material and the Ferrite Carrier for an Electrophotographic Developer According to the Present Invention>

In the ferrite carrier core material for an electrophotographic developer according to the present invention, (1) the ferrite composition contains 0.5 to 2.5% by weight of Sr; and the presence amount of Sr—Fe oxides satisfies the following conditional expression.

$$0<\text{the weight of the Sr ferrite/the total weight of all Sr—Fe oxides}\leq 0.8 \quad \text{[Expression 2]}$$

provided that the total weight of all Sr—Fe oxides=the Sr ferrite+the Sr—Fe oxides other than the Sr ferrite.

The carrier core material for an electrophotographic developer according to the present invention contains 0.5 to 2.5% by weight of Sr as described above. Sr contributes to the regulation of the resistivity and the surface property, and has not only an effect of holding a high magnetization on surface oxidation, but containing Sr has also an effect of enhancing the chargeability of a core material. In the case where Sr is less than 0.5% by weight, the effect of containing Sr cannot be provided, and the decrease in the magnetization after the surface oxidizing treatment is liable to become large. Further, since the formation amount of Sr—Fe oxides containing a Sr ferrite in the primary sintering and the regular sintering becomes too small, the effect of raising the resistivity and the charge amount of a core material cannot be expected. Particularly in the case where printing of photographs and the like at a high printing rate is continuously carried out, a decrease in charging occurs, and problems, such as toner scattering and an increase in the toner consumption amount, may possibly arise. If the content of Sr exceeds 2.5% by weight, the residual magnetization and the coercive force rise, and when the core material (coated with a resin) is used as a developer, image defects such as brush streaks occur, and the image quality decreases. A method for measuring the Sr content will be described later.

Among Sr—Fe oxides expressed by a form of $Sr_aFe_bO_c$ especially other than the Sr ferrite, there are ones having a crystal structure similar to a perovskite structure represented by $SrTiO_3$ and $BaTiO_3$, which have a high dielectric constant, like for example, $Sr_2Fe_2O_5$; and due to the presence of such Sr—Fe oxides having the crystal structure, a high chargeability as a core material can be expected to be exhibited.

A Sr ferrite is a hexagonal crystal, and the crystal structure extends in the c axis direction. On the other hand, a soft ferrite mainly constituting a core material has an isotropic spinel structure, and is a cubic crystal. The formation amounts of a Sr ferrite and a soft ferrite vary depending on the sintering temperature and/or the oxygen concentration of the calcination and/or the regular sintering. In the present invention, since the formation amount of a soft ferrite is large, and the Sr content is limited, the Sr ferrite whose amount is equal to or more than a definite amount is not formed.

Since the hexagonal crystal constituting the Sr ferrite has a different lattice constant and cannot grow in the spinel structure being a cubic crystal, the Sr ferrite is contained as a precursor (a Sr—Fe oxide) of a Sr ferrite in a soft ferrite. However, due to a local rising of the oxygen concentration and/or an increase in the heat quantity in sintering, and further the presence of impurities promoting sintering, a Sr ferrite grows (abnormal grain growth) locally, and projections are formed on the core material particle (ferrite particle) surface in some cases. Although the formation of projections more or less differs depending on the levels of the oxygen concentration and the sintering temperature, a core material particle having a larger formation amount of the Sr ferrite among Sr—Fe oxides has projections more easily formed on the surface of the core material particle. Whether the projections have been formed of Sr can be easily determined from whether Sr has segregated on the periphery of abnormally grown grains by measurement of the element distribution using EDS/EDX of the core material particle surface and/or the core material particle cross-section.

Since a Sr ferrite is formed by carrying out regular sintering at an oxygen concentration of 1,000 ppm or more, it never occurs that a Sr ferrite is formed and the value of the weight of the Sr ferrite/all Sr—Fe oxides is zero. Depending on the addition amount of Sr and the manufacturing conditions, since the regular sintering is carried out at a temperature slightly lower than a sintering temperature of forming a Sr ferrite and at an oxygen concentration of 50,000 ppm or less, the weight of the Sr ferrite/the total weight of all Sr—Fe oxides never exceeds 0.8. The weight of the Sr ferrite and the presence amount (weight) of the Sr—Fe oxides are calculated from the following X-ray diffractometry (measurement of crystal structures).

(Measurement of Crystal Structures: X-Ray Diffractometry)

An "X'PertPRO MPD", made by PANalytical B.V., was used as a measuring apparatus. A Co tube (CoKα line) was used as an X-ray source; an integrated optical system and high-speed detector "X'Celarator" was used as an optical system; and the measurement was carried out on a continuous scan of 0.2°/sec. The measurement result was data processed using analysis software "X'Pert HighScore" as in the crystal structure analysis of usual powder to identify crystal structures; and acquired crystal structures were analytically refined to thereby calculate the presence ratios in terms of weight. On the calculation of the presence ratios, since the separation of peaks of a magnesium ferrite and $Fe_3O_4$ is difficult, these were treated as a spinel phase, and for crystal structures other than those, respective presence ratios were calculated. On the identification of crystal structures, O was regarded as an essential element, and Fe, Mn, Mg and Sr were regarded as elements which may possibly be contained. Although the measurement can be carried out using a Cu tube as an X-ray source with no problem, the measurement is carried out preferably using a Co tube because a case of a sample containing much of Fe exhibits a high background as compared with a peak as a measurement object. An optical system using a parallel method may give the same result, but the measurement using an integrated optical system is preferable because the former system gives a low X-ray intensity and necessitates more time for the measurement. The speed of the continuous scan is not especially limited, but in order to acquire a sufficient S/N ratio when the analysis of crystal structures was carried out, a carrier core material was set and measured in a sample cell by making the peak intensity of the (311) plane being the main peak of the spinel structure to be 50,000 cps or more, and making the particles not to orient in a specific preferential direction.

In the carrier core material for an electrophotographic developer according to the present invention, (2) in the distribution in the number of the shape factor SF-2, the number of particles of 100 or more and less than 105 is 40% by number or more; that of 105 or more and less than 110 is 5 to 40% by number; that of 110 or more and less than 120 is 20% by number or less; that of 120 or more is 10% by number or less; and that of 130 or more is 5% by number or less.

In the case where the distribution in the number of the shape factor does not satisfy the range described in (2) described above, the presence proportion of particles whose shape is not spherical increases; and in the case where a carrier after resin coating is mixed and stirred with a toner, and the developer is put in an actual developing machine, an electric field is liable to concentrate to sharp points of the carrier particle to thereby make a substantially low resistivity, and cause carrier scattering as in the case of a low-resistivity carrier particle. Particularly, the presence of projections on the core material particle surface, the projections having different curvatures of the core material surface, though depending on the direction of an electric field, concentrate an electric field (electric lines of force) to the projections to thereby locally decrease the resistivity as compared with other portions. The case where the local decrease of the resistivity occurs in the vicinity of a photoreceptor causes white spots.

Additionally, if sharp portions are present on a ferrite carrier material particle, although resin coating can be carried out on the portions, the resin on the portions may possibly exfoliate earlier by stirring by a developing machine than the resin on recessed portions, and due to the resistivity reduction caused by nonuniformity of the resin coating as described above in addition to the resistivity reduction caused by the electric field concentration to the core material, the carrier scattering may highly possibly occur even in the early period of the life. Even if the width of the particle size distribution (expressed, for example, as a CV value) is nearly equal, since the particle diameter is smaller than those of ferrite core material particles conventionally practically used, not only the substantial width of the particle size distribution is narrow, but projections present on the core material particle, which does not conventionally pose a problem, are relatively large accompanying the particle size reduction; so, the influence of the projections becomes remarkably large.

In the evaluation of a carrier core material, the degree of deviation in the surface shape cannot be expressed only by the definition of an average value of the shape factor SF-2. Only definitions of the grain size on the surface, the average size of grain boundaries, and the size deviation to the average particle diameter of the particle are not also insufficient. Additionally, expression of the degree of deviation described above in a limited sampling number of about several tens to 300 cannot provide a highly reliable numerical value.

(The Shape Factor SF-2 (Roundness))

The shape factor SF-2 is a numerical value obtained by dividing the square of a projected peripheral length of a carrier by a projected area of the carrier, dividing the quotient by 4π, and multiplying the quotient by 100; and the shape factor SF-2 of a carrier whose shape is nearer a sphere has a value nearer 100. The shape factor SF-2 (roundness) is measured as follows.

3,000 core material particles are observed using a size/shape analyzer PITA-1, made by Seishin Enterprise Co., Ltd.; S (projected area) and L (projected peripheral length) are determined using software ImageAnalysis, attached to the analyzer, to obtain a shape factor SF-2 from the expression shown below. The shape factor SF-2 of a carrier whose shape is nearer a sphere has a value nearer 100.

A sample liquid used was prepared by dispersing 0.1 g of a core material particle in 30 cc of a xanthan gum aqueous solution having a viscosity of 0.5 Pa·s prepared as a dispersion medium. By properly adjusting the viscosity of the dispersion medium in such a way, the core material particle could be held in the state of being dispersed in the dispersion medium, and the measurement could be carried out smoothly. The measurement conditions used were: the magnification of an (objective) lens was 10×; the filter was ND4×2; the carrier liquid 1 and the carrier liquid 2 used a xanthan gum aqueous solution having a viscosity of 0.5 Pa·s; and the flow rates were each 10 μl/sec; and the sample liquid flow rate was 0.08 μl/sec.

$$SF-2=L^2/S/4\pi\times100 \quad \text{[Expression 3]}$$

wherein L represents a projected peripheral length, and S represents a projected area.

In the carrier core material for an electrophotographic developer according to the present invention, (3) the BET specific surface area is 0.15 to 0.30 $m^2/g$, preferably 0.15 to 0.25 $m^2/g$, and more preferably 0.15 to 0.22 $m^2/g$.

In the case where the BET specific surface area is less than the range described above, not only an anchor effect of a resin cannot sufficiently be obtained even if the resin coating is carried out, but carrier core material particles are aggregated due to the resin which has not been used for coating in some cases. The substantial coating resin amount therefore decreases, and the life as a carrier is shortened; and the aggregated core particles are deagglomerated in a developing machine to thereby largely expose the carrier core material surface and to thereby reduce the resistivity, causing the occurrence of carrier scattering. In the case where the BET specific surface area is larger than the range described above, since the coating resin does not remain on the core material surface and excessively soak, a desired resistivity and charge amount as a carrier cannot be obtained in some cases. When the BET specific surface area is measured, since the measurement result is strongly influenced by moisture of the core material particle surface of a measuring sample, a pretreatment is preferably carried out in which moisture adhered to the sample surface is removed as much as possible.

The measurement of the BET specific surface area used a specific surface area analyzer (model: GEMINI 2360 (made by Shimadzu Corp.)). About 10 to 15 g of a measuring sample was put in a measuring cell, and weighed precisely by a precision balance; after the weighing, the sample was subjected to a vacuum suction heat treatment at 200° C. for 120 min in a gas port attached to the analyzer. Then, the sample was set on a measuring port, and the measurement was started. The measurement was carried out in 10-point method; the weight of the sample was input at the time of the completion of the measurement, so that the BET specific surface area was automatically calculated.

Measuring cell: spherical outer shape: 1.9 cm (¾ inch), length: 3.8 cm (1½ inches), cell length: 15.5 cm (6.1 inches), volume: 12.0 $cm^3$, and sample volume: about 6.00 $cm^3$ Environment: temperature: 10 to 30° C., relative humidity: 20 to 80%, and no dew condensation In the carrier core material for an electrophotographic developer according to the present invention, (4) the average particle diameter $D_{50}$ in measurement by a laser diffraction type particle size analyzer is 20 to 35 μm, and preferably 22 to 32 μm.

In the case where the average particle diameter is less than the range described above, since the magnetic force per one core material particle is small, the carrier scattering cannot be prevented even if the particle shape and the BET specific surface area are in the ranges described above. In the case where the average particle diameter is larger than the range described above, when a developer is fabricated, a high toner concentration cannot be achieved, and a high-quality image printed matter cannot be obtained; or, when a high toner concentration is made, the charge amount of the developer rapidly decreases or the charge amount distribution broadens, causing toner scattering.

(Volume-Average Particle Diameter)

The average particle diameter was measured by a laser diffraction scattering method. As a measuring device, a MicroTrack particle size analyzer (Model: 9320-X100), made by Nikkiso Co., Ltd. was used. The measurement was carried out at a refractive index of 2.42 and under the environment of 25±5° C. and a humidity of 55±15%. The average particle diameter (median diameter) used here refers to a cumulative-50% particle diameter in the volume distribution mode and the undersize expression.

Dispersion of a carrier sample used a 0.2% sodium hexametaphosphate aqueous solution as a dispersion medium solution, and was carried out by an ultrasonic treatment for 1 min by an Ultrasonic Homogenizer (UH-3C), made by Ultrasonic Engineering Co., Ltd.

In the ferrite carrier core material for an electrophotographic developer according to the present invention, (5) the magnetization by VSM measurement when a magnetic field of 1K·1000/4π·A/m is impressed is 50 to 65 $Am^2/kg$. If the magnetization at the 1K·1000/4π·A/m is less than 50 $Am^2/kg$, the magnetization of scattering materials deteriorates, causing image defects due to carrier beads carry over. By contrast, in the compositional range described above according to the present invention, the magnetization never exceeds 65 $Am^2/kg$. This magnetic property (magnetization) is measured as follows.

(Magnetic Property)

The measurement of the magnetization used a vibrating sample-type magnetometer (model name: VSM-C7-10A, made by Toei Industry Co., Ltd.). A measuring sample was filled in a cell of 5 mm in inner diameter and 2 mm in height, and set on the magnetometer. The measurement was carried out by impressing a magnetic field and sweeping the impressed magnetic field to 5 kOe. Then, the impressed magnetic field was reduced, and a hysteresis curve was fabricated on a recording paper. The magnetization at an impressed magnetic field of 1 KOe was read out from data of the curve.

A ferrite core material particle for an electrophotographic developer satisfying the ranges (1) to (5) described above has a larger BET specific surface area than conventional core material particles because having fine unevenness present on the surface although having a nearly spherical particle shape in spite of having a small particle diameter, has an excellent charging property, hardly causes carrier scattering due to cracking and chipping of the core material particle, and exhibits a prolonged life.

The ferrite carrier core material according to the present invention preferably comprises Mn and Mg in addition to Sr as described above; and the core material contains preferably 15 to 22% by weight, more preferably 17 to 22% by weight, and still more preferably 18 to 21% by weight of Mn; preferably 0.5 to 3% by weight, more preferably 0.5 to 2.5% by weight, and still more preferably 0.5 to 2% by weight of Mg; and preferably 45 to 55% by weight, more preferably 47 to 55% by weight, and still more preferably 48 to 55% by weight of Fe, and contains O (oxygen) and accompanying impurities as a remainder, wherein the accompanying impurities are ones contained in the raw material and ones mingled in manufacturing processes, and the total amount thereof is 0.5% by weight or less.

Making Mn contained can raise the magnetization on the low-magnetic field side, and can be expected to provide a preventive effect on reoxidation when a core material is taken out from a furnace in regular sintering. The form of Mn when added is not especially limited, but is preferably $MnO_2$, $Mn_2O_3$, $Mn_3O_4$ or $MnCO_3$, because these are easily available as the industrial application. With the content of Mn of less than 15% by weight, the content of Fe relatively increases. Consequently, not only since a magnetite component is much present, and the magnetization on the low-magnetic field side is low, the carrier beads carry over occurs, but since the resistivity also is low, the image quality deteriorates, including occurrence of fogging and deterioration of gradation. If the content of Mn exceeds 22% by weight, since the edge effect excessively acts because the resistivity becomes high, image defects such as voids occur, and the toner consumption increases in some cases.

Making Mg contained can provide a developer constituted of a ferrite carrier and a full-color toner and exhibiting good charge rise, and can also raise the resistivity. With the content of Mg of less than 0.5% by weight, a sufficient effect of the addition cannot be obtained; in the case where the content of Mn is relatively small and the content of Fe is large, the resistivity is low, and the image quality deteriorates, including the occurrence of fogging and the deterioration of gradation. In the case where the content of Mn is relatively large and the content of Fe is small, since the magnetization becomes too high, the ear of a magnetic brush becomes hard, causing the occurrence of image defects such as brush streaks. By contrast, if the content of Mg exceeds 3% by weight, since the magnetization decreases, not only the carrier scattering occurs, but in the case of a low sintering temperature, an influence of a hydroxyl group attributed to Mg makes the adsorption amount of moisture large, causing the deterioration of the environmental dependency of electric properties such as the charge amount and the resistivity.

With the content of Fe of less than 45% by weight, the case where the content of Mg relatively increases means an increase in a low-magnetization component, which cannot provide desired magnetic properties. In the case where the content of Mn relatively increases, since the magnetization is too high, the ear of a magnetic brush become hard, causing the occurrence of image defects such as brush streaks, and since the edge effect excessively acts because the resistivity becomes high, image defects such as voids occur, and the toner consumption increases in some cases. If the content of Fe exceeds 55% by weight, the effect of containing Mg and/or Mn cannot be obtained, resulting in becoming a ferrite carrier core material substantially equivalent to magnetite.

(Contents of Fe, Mn, Mg and Sr)

The contents of these Fe, Mn, Mg and Sr were measured as follows.

0.2 g of a ferrite carrier core material was weighed and added to a solution in which 20 ml of 1N hydrochloric acid and 20 ml of 1N nitric acid were added to 60 ml of pure water, and the solution was heated to prepare an aqueous solution in which the ferrite carrier core material was completely dissolved; and the contents of Fe, Mn, Mg and Sr were measured using an ICP spectrometer (ICPS-10001V, made by Shimadzu Corp.).

The carrier core material for an electrophotographic developer according to the present invention desirably has the surface having been subjected to an oxidation treatment. The thickness of the oxidatively treated film formed by the surface oxidation treatment is preferably 0.1 nm to 5 μm. If the thickness of the film is less than 0.1 nm, the effect of the oxide film layer is small; and if the thickness of the film exceeds 5 μm, since the magnetization obviously decreases and the resistivity becomes too high, problems such as a decrease in the developability are liable to occur. As required, reduction may be carried out before the oxidation treatment. The oxidatively treated film can be known from variations of peaks and/or integral intensities accompanying valence variations from divalence to tri and/or tetravalence of Mn by X-ray photoelectron spectroscopy (XPS). The presence/absence of the oxidatively treated film can also be known indirectly from a variation of the resistivity before and after the surface oxidation treatment. The oxide film may be formed uniformly on the core material surface, or may be formed partially. Since there is a high possibility that compounds containing $Mn^{3+}$ and/or $Mn^{4+}$ formed by the surface oxidation treatment are present unevenly on the core material particle surface, the measurement of the presence is difficult by X-ray diffraction. In other words, in the surface oxidation treatment described in the present application, compounds containing $Mn^{3+}$ and/or $Mn^{4+}$ are preferably present in such a degree that the presence of the compounds containing $Mn^{3+}$ and/or $Mn^{4+}$ can be measured by measurement means (for example, XPS and the like) other than X-ray diffraction, and cannot be detected by X-ray diffraction.

If the half value width and the peak position of the (311) plane being the main peak of the spinel structure before the surface oxidation treatment are taken as W11 (deg) and P1 (deg), respectively, and the half value width and the peak position thereof after the surface oxidation treatment are taken as W21 (deg) and P2 (deg), respectively, the crystallinity of the ferrite carrier core material (ferrite particle) preferably satisfies the following conditions.

$$1 < W21/W11 \leq 1.5 \text{ and } 0 < P2-P1 \leq 0.2 \text{ (deg)} \quad \text{[Expression 4]}$$

W21/W11 of less than 1 means no effect of the surface oxidation treatment. By contrast, in the case where W21/W11 is larger than 1.5, not only since lattice defects become too many and the effect of resistivity reduction due to the lattice defects becomes larger than that of resistivity enhancement due to the oxidation treatment, the resistivity enhancement by the oxidation treatment cannot consequently be achieved, but also since the magnetization remarkably decreases due to the crystallinity decreases, a core material particle having desired properties cannot be obtained.

With respect to P2−P1, in the case of $-0.001 < P2-P1 \leq 0$, since the lattice constant does not vary and the peak position does not shift, the oxidation treatment can be considered to have no effect. In the case of $P2-P1 > 0.2$, although the lattice constant becomes small as lattice defects become many, the case means that the lattice defects are present too many. That is, part of ferrite components is formed as other compounds, and the remaining ferrite component assumes a structure similar to $\gamma$-$Fe_2O_3$; and the effect of resistivity reduction due to too many lattice defects becomes larger than the resistivity enhancement due to the oxidation treatment, resulting in not achieving resistivity enhancement by the oxidation treatment. The evaluation of the crystallinity is as described above. Since a peak shift of the diffraction pattern by the surface oxidation treatment is caused by a reduction of the lattice constant, in the case of $P2-P1 \leq -0.001$, the peak shift can be considered not to be due to the surface oxidation treatment even if taking the measurement error into consideration.

It can be further expected that carrying out the surface oxidation treatment by heating a ferrite carrier core material (ferrite particle) relaxes stresses (those of the crystal lattice)

generated in the ferrite particle, and the strength of the ferrite particle is improved. A ferrite carrier for an electrophotographic developer using a ferrite particle having large stresses, when the ferrite carrier is mixed with a toner and used as a developer, may possibly be broken during stirring in a developing machine, causing carrier scattering, drum flaws and the like.

If the half value width of the peak of the (311) plane of the spinel structure before the surface oxidation treatment and the half value width of the (622) plane thereof are taken as W11 and W12, respectively, and the half value width of the peak of the (311) plane of the spinel structure after the surface oxidation treatment and the half value width of the (622) plane thereof are taken as W21 and W22, respectively, and WS1=W12/W11 and WS2=W22/W21, the internal stress of a ferrite particle as a ferrite carrier core material preferably satisfies the following condition.

$$WS2 < WS1 \quad \text{[Expression 5]}$$

By satisfying the range described above, the internal stress of a ferrite particle is reduced by the surface oxidation treatment; and when the ferrite particle is used as a ferrite carrier for an electrophotographic developer, not only the magnetization and the resistivity are balanced, but also the ferrite particle is hardly broken and the ferrite carrier can provide good images continuously and stably. By contrast, the case of WS2≥WS1 means that the influence of being inferior in the crystallinity due to the surface oxidation treatment is larger than the effect of the reduction of the stress of the ferrite particle due to the surface oxidation treatment, and can provide a ferrite carrier which is hardly broken, but cannot provide a desired resistivity and magnetization.

The evaluation of the internal stress of a ferrite particle becomes hardly susceptible to the influences of the measurement conditions and the measuring apparatus by always taking as a reference the half value width of the (311) plane being the main peak of the spinel structure like WS1 and WS2, and is more versatile than the evaluation directly using W12 and W22 as half value widths of the (622) plane of the spinel structure, and is superior also in precision thereto. Although whether the crystallinity is good or poor can be determined only by the half value width of the (311) plane to some degree, information on the strain of the entire of the spinel structure cannot be obtained. Therefore, in order to obtain information on the strain of the entire of the spinel structure, the evaluation of the stress is preferably carried out by taking the (311) plane as a reference in addition to acquisition of information on the (622) plane which is on the same series as the main peak.

In the ferrite carrier core material for an electrophotographic developer according to the present invention, the Cl elusion amount using a pH4 standard solution is desirably 0.1 to 150 ppm. If much of chlorides and chloride ions are present on the ferrite carrier core material (ferrite particle) surface, since a carrier and a developer are liable to adsorb moisture (water molecules) present in the use environment, the environmental variation in electric properties including the charge amount becomes large. Chlorides and chloride ions need to be decreased as much as possible.

However, as iron oxide as one of carrier core material (ferrite particle) raw materials, use of an iron oxide by-produced from the hydrochloric acid pickling step carried out in steel production is common, and the iron oxide contains chlorides and chloride ions as inevitable impurities. Although most part of the chlorides and chloride ions are removed in a treatment in the temperature region of 1,000 to 1,500° C. in a sintering step using a batch type electric furnace or a rotary electric furnace as one of ferrite production steps, heat hardly spreads inside the raw materials, and a part thereof comes to remain. Particularly in the case where a ferrite particle having a relatively large surface area is manufactured in order to enhance the chargeability, since the sintering temperature needs to be set rather low, chlorides and chloride ions are liable to remain.

Additionally, if the BET specific surface area is made large in order to enhance the chargeability, since the ferrite particle contains more of chlorides and/or chloride ions remaining on the core material particle surface than ferrite particles used for common resin-coated ferrite carriers, carrier properties are largely affected.

Therefore, in the present invention, as described above, the Cl elution amount using a pH standard solution of the ferrite carrier core material is desirably 0.1 to 150 ppm. The Cl elution amount is desirably 0.1 to 100 ppm, and more desirably 0.1 to 80 ppm. The environmental variation in electric properties such as the charge amount is small in this elution range. Subjecting the ferrite carrier core material to the oxide film forming treatment described above allows the charge amount to be raised though the BET specific surface area is large, and gives a small environmental variation.

If the Cl elution amount exceeds 150 ppm, since moisture (water molecules) present in the use environment is liable to be adsorbed as described above, the environmental variation in electric properties such as the charge amount becomes large, which is not preferable. Even if an oxide film forming treatment described later is carried out, high charging can hardly be obtained. Also in a case where the ferrite carrier core material surface is coated with a resin, the Cl components remaining on the ferrite carrier core material and the coating resin interact, thereby being liable to cause a decrease in the charge amount.

Making the Cl elution amount less than 0.1 ppm is industrially difficult. As raw materials generally used for ferrites and ferrite carriers for electrophotographic developers, particularly a raw material containing much of Cl is iron oxide. This is because as iron oxide, use of an iron oxide by-produced from the hydrochloric acid pickling step carried out in steel production is industrially common. Such an iron oxide comes in several grades, but contains several hundred ppm of Cl. Iron oxide industrially used and containing the least of Cl contains about 200 ppm of Cl.

There are various types of measurement methods of the Cl concentration. One of them is a method of using an X-ray fluorescence element analyzer, as described, for example, in Japanese Patent Laid-Open No. 2006-267345. However, the method of measuring the Cl concentration by an X-ray fluorescence element analyzer is an effective method for measuring not only Cl present in the vicinity of the surface but also directly Cl present in the particle interior not affected by the external environment. In the present invention, it has been found that especially Cl present in the vicinity of the surface causes an interaction with moisture in the air, thereby adversely affecting the environmental variation in the charge properties, and it has been further found that chlorides on the surface are influenced by moisture, and such chlorides are liable to come off, thereby decreasing the chargeability itself, and the Cl basically has no relation with Cl present in the particle interior. Therefore, in the present invention, specifying and controlling the Cl concentration present on the ferrite particle surface is very important. As such a measurement method, an elution method described below is used.

[Cl Concentration: The Elution Method]

(1) 50.000 g+0.0002 g or less of a sample is accurately weighed, and put in a 150-ml glass bottle.

(2) 50 ml of a phthalate salt (pH: 4.01) is added to the glass bottle.

(3) 1 ml of an ion strength regulator is then added to the glass bottle, and the lid is closed.

(4) The mixture is stirred for 10 min by a paint shaker.

(5) The mixture is filtrated to a 50-ml PP-made vessel by using a No. 5B filter paper while taking caution so that the carrier does not drop by laying a magnet on the bottom of the 150-ml glass bottle.

(6) An obtained supernatant is measured for the voltage by a pH meter.

(7) Solutions by Cl concentrations (pure water, 1 ppm, 10 ppm, 100 ppm and 1,000 ppm) fabricated for a calibration curve are similarly measured, and the Cl elution of the sample is calculated from these values.

In the ferrite carrier core material for an electrophotographic developer according to the present invention, the resistivity at an impressed voltage of 100 V at a 1-mm gap is desirably $1\times10^7$ to $5\times10^8\Omega$.

In the case where the resistivity at an impressed voltage of 100 V at a 1-mm gap is lower than $1\times10^7$, the resistivity is too low and white spots and carrier scattering may possibly occur in use as a carrier. In the case where that is higher than $5\times10^8\Omega$, images in which the edge effect excessively acts are made in use as a carrier, and the consumption amount of a toner increases in some cases.

(The Electric Resistivity)

The electric resistivity is measured as follows.

Non-magnetic parallel flat plate electrodes (10 mm×40 mm) are opposed to each other with an electrode interval of 1.0 mm, and 200 mg of a sample is weighed and filled therebetween. A Magnet (surface magnetic flux density: 1,500 Gauss, the area of the magnet brought into contact with the electrodes: 10 mm×30 mm) is attached to the parallel flat plate electrodes to hold the sample between the electrodes; and the resistivity at an impressed voltage of 100 V is measured by an insulation resistance tester (SM-8210, made by DKK-TOA Corp.).

In the carrier for an electrophotographic developer according to the present invention, the surface of the carrier core material is coated with a resin. The number of times of resin coating may be only once, or two or more times, and the number of times of coating can be decided according to desired properties. The composition and the coating amount of the coating resin and an apparatus used for the resin coating may be changed or may not be changed for every coating in the case where the number of times of coating is two or more times.

The resin-coated carrier for an electrophotographic developer according to the present invention desirably has a total resin film amount of 0.1 to 10% by weight with respect to the carrier core material. With the total film amount of less than 0.1% by weight, it is difficult to form a uniform film layer on the carrier surface; and if the total film amount exceeds 10% by weight, aggregation of carrier particles comes to occur, thereby causing a decrease in productivity such as a decrease in yield, and also variations in developer properties, such as the fluidity or the charge amount, in actual machines.

The film forming resin used here can suitably be selected depending on a toner combined and the environment used and the like. The kind thereof is not especially limited, but examples thereof include fluororesins, acrylic resins, epoxy resins, polyamide resins, polyamide imide resins, polyester resins, unsaturated polyester resins, urea resins, melamine resins, alkyd resins, phenol resins, fluoroacrylic resins, acrylstyrene resins, silicone resins, and modified silicone resins modified with a resin such as acrylic resins, polyester resins, epoxy resins, polyamide resins, polyamide imide resins, alkyd resins, urethane resins and fluororesins. Most preferably used in the present invention is an acrylic resin, a silicone resin or a modified silicone resin.

In order to control the electric resistivity, the charge amount and the charging rate of a carrier, a film forming resin may contain a conductive agent. Since a conductive agent itself has a low electric resistivity, too high a content thereof is liable to cause rapid charge leakage. Therefore, the content thereof is 0.25 to 20.0% by weight, preferably 0.5 to 15.0% by weight, and especially preferably 1.0 to 10.0% by weight, with respect to a solid content of the film forming resin. The conductive agent includes conductive carbon, oxides such as titanium oxide and tin oxide, and various types of organic conductive agents.

The film forming resin may contain a charge control agent. Examples of the charge control agent include various types of charge control agents commonly used for toners, and various types of silane coupling agents. This is because, in the case where the exposed core material area is controlled so as to become relatively small by the film formation, the charging capability decreases in some cases, but addition of various types of charge control agents and silane coupling agents can control the charging capability. The type of charge control agents and coupling agents usable is not especially limited, but is preferably a charge control agent such as nigrosine dyes, quaternary ammonium salts, organic metal complexes or metal-containing monoazo dyes, and an aminosilane coupling agent, a fluorine-based silane coupling agent or the like.

<Manufacturing Methods of the Carrier Core Material and the Carrier for an Electrophotographic Developer According to the Present Invention>

Then, manufacturing methods of the carrier core material and the carrier for an electrophotographic developer according to the present invention will be described.

The manufacturing method of the carrier core material for an electrophotographic developer according to the present invention involves pulverizing an Fe compound, and preferably in addition to this, each of compounds of Mn and Mg, mixing and calcining them, and thereafter, again pulverizing the calcined material, adding a Sr compound to the obtained pulverized material, mixing and granulating the Sr-added material, primarily sintering and regularly sintering the obtained granulated material, and further deagglomerating and classifying the sintered material, and as required, subjecting the classified material to a surface oxidation treatment.

The method of pulverizing each of these compounds, and mixing and calcining them, and thereafter, again pulverizing, mixing and granulating the calcined material to prepare a granulated material is not especially limited, and conventionally well-known methods can be employed, and a dry-type method or a wet-type method may be used. For example, $Fe_2O_3$, $Mg(OH)_2$ and/or $MgCO_3$ and one or more Mn compounds selected from $MnO_2$, $Mn_2O_3$, $Mn_3O_4$ and $MnCO_3$ as raw materials are mixed, and calcined in the atmosphere. After the calcination, the obtained calcined material is further pulverized by a ball mill, a vibration mill or the like; thereafter, a Sr compound such as $SrCO_3$, water and as required, a dispersant, a binder and the like are added thereto; and after viscosity regulation, the mixture is granulated by a spray drier. In the pulverization after the calcination, the pulverization may be carried out by adding water and using a wet-type ball mill, a wet-type vibration mill or the like. As the binder, use of polyvinyl alcohol or polyvinyl pyrrolidone is preferable.

In the manufacturing method according to the present invention, after the obtained granulated material is primarily sintered, a regular sintering is carried out. Here, the primary sintering is carried out at 600 to 800° C. The regular sintering is carried out in an inert atmosphere or a weak oxidative atmosphere, for example, in a mixed gas atmosphere of nitrogen and oxygen in which the oxygen concentration is 0.1% by volume (1,000 ppm) to 5% by volume (50,000 ppm), more preferably 0.1% by volume (1,000 ppm) to 3.5% by volume (35,000 ppm), and most preferably 0.1% by volume (1,000 ppm) to 2.5% by volume (25,000 ppm), at 1,100 to 1,200° C.

When the regular sintering is carried out using a sintering furnace having a form in which a material is passed through a hot section while being fluidized in the furnace as in a rotary kiln, in the case where the oxygen concentration of the sintering atmosphere is low, the material is liable to adhere in the furnace, and a sintered material is discharged out of the furnace before being sufficiently sintered as a sintered material having a good fluidity. Therefore, even if the BET specific surface area is nearly in the range prescribed in the present invention, and even if the sintering of the surface of the core material particle sufficiently progresses, the sintering of the particle interior does not progress, whereby the core material particle may possibly be one not having a sufficient strength as a core material particle for an electrophotographic developer. Therefore, a tunnel kiln, an elevator kiln or the like is desirably used in which the raw material having been put in a sagger or the like before the sintering and allowed to stand still, if possible, is passed through a hot section.

As described above, control of the formation amount of a Sr ferrite among Sr—Fe oxides can provide the surface of the core material particle with uniformity, which is impossible conventionally. A concrete method for controlling the Sr ferrite formation suffices if the heat histories for a soft ferrite having a spinel structure and Sr—Fe compounds constituting a core material are differentiated, and it is preferable that a Sr compound is not added at the calcination stage, and a soft ferrite is allowed to be easily formed in the regular sintering. Then, addition of the Sr compound at the stage of the regular granulation forms the soft ferrite earlier than the Sr ferrite in the regular sintering, thus resulting in suppression of the formation amount of the Sr ferrite.

Additionally, since a Sr ferrite is formed in a temperature region exceeding 1,230° C. and/or in a relatively high oxygen concentration of the sintering atmosphere exceeding 5% by volume in the regular sintering, by shifting the formation conditions (regular sintering conditions) of a soft ferrite from the conditions described above, the formation amount of the Sr ferrite can easily be suppressed although the Sr ferrite is formed partially. Concretely, it is preferable that the regular sintering temperature is 1,100 to 1,200° C. and/or the oxygen concentration is 0.1 to 5% by volume as described above. Setting such regular sintering conditions can provide a core material having desired various properties such as the magnetization, the resistivity and the charge amount of the core material, and simultaneously having a uniform surface property.

Thereafter, the sintered material is deagglomerated and classified to obtain a carrier core material (ferrite particle). The sintered material is size-regulated to a desired particle diameter using a classification method such as an existing air classification, mesh filtration or precipitation method. In the case of carrying out dry-type collecting, the collecting may be carried out by a cyclone or the like. When the size-regulation is carried out, two or more of the classification methods described above may be selected, or coarse power-side particles and fine powder-side particles may be removed by changing conditions of one classification method.

Thereafter, as required, the surface is subjected to an oxide film forming treatment by low-temperature heating to regulate the electric resistivity. The oxide film forming treatment uses a common rotary electric furnace, batch type electric furnace or the like, and involves a heat treatment at 650° C. or lower, and preferably at 450 to 650° C. under an oxygen-containing atmosphere. The case of 450° C. or lower does not sufficiently progress the oxidation of the core material particle surface, which may possibly not provide a desired resistivity. The case of 650° C. or higher excessively progress the oxidation of Mn, which progresses the resistivity reduction of a core material caused by the crystallinity of the spinel structure being degraded, which is not preferable. In order to form an oxide film uniformly on a core material particle, use of a rotary electric furnace is preferable.

In oxidation of the ferrite carrier core material (ferrite particle) surface by mechanical impacts such as stirring stresses, since the heat amount does not become a heat amount enough to restructure the crystal structure even if the temperature becomes high momentarily, the stresses (strains of the crystal lattice) cannot be diminished, and the improvement in the strength of the ferrite particle cannot be expected.

Since ferrite particles having a small particle diameter contact more with each other than ferrite particles having a large particle diameter, the resistivity of the low-electric field side of the ferrite particles having a small particle diameter is liable to be lower than that of the ferrite particles having a large particle diameter. Additionally, since the BET specific surface area becomes large to thereby allow a current to easily flow, the resistivity is liable to be reduced, and this emerges remarkably on the low-electric field side, in which the influence of the electric field hardly reaches the ferrite interior.

In the ferrite carrier for an electrophotographic developer according to the present invention, the surface of the ferrite carrier core material is coated with a resin described above to form a resin film. The coating can be carried out by a well-known coating method, for example, a brush coating method, a spray dry system using a fluidized bed, a rotary dry system, a dip-and-dry method using a universal stirrer, or the like. In order to improve the surface coverage, the method using a fluidized bed is preferable.

In a case where after a ferrite carrier core material is coated with a resin, baking is carried out, the baking may be carried out using either of an external heating system and an internal heating system, for example, a fixed or fluidized electric furnace, a rotary electric furnace, a burner furnace or a microwave system. In the case of using a UV curing resin, a UV heater is used. The baking temperature is different depending on a resin to be used, but needs to be a temperature equal to or higher than the melting point or the glass transition point; and for a thermosetting resin, a condensation-crosslinking resin or the like, the temperature needs to be raised to a temperature at which the curing progresses fully.

<The Electrophotographic Developer According to the Present Invention>

Then, the electrophotographic developer according to the present invention will be described.

The electrophotographic developer according to the present invention comprises the above-mentioned ferrite carrier for an electrophotographic developer, and a toner.

A toner particle constituting the electrophotographic developer according to the present invention includes a pulverized toner particle produced by a pulverizing method and a polymerized toner particle produced by a polymerizing method. In the present invention, the toner particles obtained by either of the methods can be used.

The pulverized toner particle can be obtained by sufficiently mixing, for example, a binding resin, a charge control agent and a colorant by a mixer such as a Henschel mixer, then melting and kneading the mixture by a twin-screw extruder or the like, cooling, then pulverizing and classifying the extruded material, and adding external additives to the classified material, and then mixing the mixture by a mixer or the like.

The binding resin constituting the pulverized toner particle is not especially limited, but includes polystyrene, chloropolystyrene, styrene-chlorostyrene copolymers, styrene-acrylate ester copolymers, styrene-methacrylic acid copolymers, and additionally rosin-modified maleic resins, epoxy resins, polyester resins and polyurethane resins. These are used singly or as a mixture thereof.

The charge control agent usable is an optional one. Examples of a positively chargeable toner include nigrosine dyes and quaternary ammonium salts; and examples of a negatively chargeable toner include metal-containing monoazo dyes.

The colorant (coloring material) usable is a conventionally known dye and pigment. For example, usable are carbon black, phthalocyanine blue, Permanent Red, chrome yellow, phthalocyanine green and the like. Besides, external additives, such as silica powder and titania, to improve the fluidity and endurance for aggregation of a toner, may be added depending on the toner particle.

The polymerized toner particle is a toner particle produced by a well-known method such as a suspension polymerization method, an emulsion polymerization method, an emulsion aggregation method, an ester extension polymerization method or a phase transition emulsion method. Such a polymerized toner particle is obtained, for example, by mixing and stirring a colored dispersion liquid in which a colorant is dispersed in water using a surfactant, a polymerizable monomer, a surfactant and a polymerization initiator in an aqueous medium to emulsify and disperse and polymerize the polymerizable monomer in the aqueous medium under stirring and mixing, thereafter adding a salting-out agent to salt out a polymer particle. A polymerized toner particle can be obtained by filtering, washing and drying the particle obtained by the salting-out. Thereafter, as required, external additives to impart functions may be added to the dried toner particle.

When the polymerized toner particle is produced, in addition to the polymerizable monomer, the surfactant, the polymerization initiator and the colorant, a fixation improving agent and a charge control agent may be further blended, whereby various properties of a polymerized toner particle thus obtained can be controlled and improved. In order to improve the dispersibility of the polymerizable monomer in the aqueous medium, and regulate the molecular weight of a polymer obtained, a chain transfer agent may be further used.

The polymerizable monomer used for production of the polymerized toner particle is not especially limited, but examples of the monomers include styrene and its derivatives, ethylenic unsaturated monoolefins such as ethylene and propylene, halogenated vinyls such as vinyl chloride, vinyl esters such as vinyl acetate, and $\alpha$-methylene aliphatic monocarboxylate esters such as methyl acrylate, ethyl acrylate, methyl methacrylate, ethyl methacrylate, 2-ethylhexyl methacrylate, acrylic acid dimethyl amino ester and methacrylic acid diethyl amino ester.

The colorant (coloring material) usable in preparation of the polymerized toner particle is a conventionally known dye and pigment. For example, usable are carbon black, phthalocyanine blue, Permanent Red, chrome yellow, phthalocyanine green and the like. These colorants may be modified on their surface using a silane coupling agent, a titanium coupling agent or the like.

The surfactant usable in production of the polymerized toner particle is an anionic surfactant, a cationic surfactant, an amphoteric surfactant and a nonionic surfactant.

Here, the anionic surfactant includes fatty acid salts such as sodium oleate and castor oil, alkylsulfate esters such as sodium laurylsulfate and ammonium laurylsulfate, alkylbenzenesulfonate salts such as sodium dodecylbenzenesulfonate, alkylnaphthalenesulfonates, alkylphosphate salts, naphthalenesulfonic acid-formalin condensates and polyoxyethylene alkylsulfate salts. The nonionic surfactant includes polyoxyethylene alkyl ethers, polyoxyethylene fatty acid esters, sorbitan fatty acid esters, polyoxyethylene alkylamines, glycerol, fatty acid esters and oxyethylene-oxypropylene block polymers. Furthermore, the cationic surfactant includes alkylamine salts such as laurylamine acetate, and quaternary ammonium salts such as lauryltrimethylammonium chloride and stearyltrimethylammonium chloride. Then, the amphoteric surfactant includes aminocarboxylate salts and alkylamino acids.

A surfactant as described above can be used usually in an amount in the range of 0.01 to 10% by weight with respect to a polymerizable monomer. Such a surfactant influences the dispersion stability of a monomer, and influences also the environmental dependency of a polymerized toner particle obtained. The use thereof in the range described above is preferable from the viewpoint of securing the dispersion stability of the monomer and reducing the environmental dependency of the polymerized toner particle.

For production of a polymerized toner particle, a polymerization initiator is usually used. The polymerization initiator includes a water-soluble polymerization initiator and an oil-soluble polymerization initiator. In the present invention, either of them can be used. Examples of the water-soluble polymerization initiators usable in the present invention include persulfate salts such as potassium persulfate and ammonium persulfate, and water-soluble peroxide compounds. Examples of the oil-soluble polymerization initiators include azo compounds such as azobisisobutyronitrile, and oil-soluble peroxide compounds.

In the case of using a chain transfer agent in the present invention, examples of the chain transfer agents include mercaptans such as octylmercaptan, dodecylmercaptan and tert-dodecylmercaptan, and carbon tetrabromide.

Further in the case where a polymerized toner particle used in the present invention comprises a fixability improving agent, the fixability improving agent usable is natural waxes such as carnauba wax, and olefinic waxes such as polypropylene and polyethylene.

In the case where the polymerized toner particle used in the present invention comprises a charge control agent, the charge control agent to be used is not especially limited, and usable are nigrosine dyes, quaternary ammonium salts, organic metal complexes, metal-containing monoazo dyes, and the like.

External additives to be used for improving the fluidity and the like of a polymerized toner particle include silica, titanium oxide, barium titanate, fluororesin microparticles and acrylic resin microparticles. These may be used singly or in combination thereof.

The salting-out agent to be used for separation of a polymerized particle from an aqueous medium includes metal salts such as magnesium sulfate, aluminum sulfate, barium chloride, magnesium chloride, calcium chloride and sodium chloride.

The toner particle produced as described above has a volume-average particle diameter in the range of 2 to 15 μm, and preferably 3 to 10 μm, and the polymerized toner particle has a higher uniformity of particles than the pulverized toner particle. If the toner particle is less than 2 μm, the chargeability decreases and fogging and toner scattering are liable to be caused; and the toner particle exceeding 15 μm causes the deterioration of the image quality.

The carrier and the toner produced as described above may be mixed to obtain an electrophotographic developer. The mixing ratio of the carrier and the toner, that is, the toner concentration is preferably set at 3 to 15% by weight. The toner concentration less than 3% by weight hardly provide a desired image density; and the toner concentration exceeding 15% by weight is liable to generate toner scattering and fogging.

The electrophotographic developer according to the present invention may be used as a refill developer. In this case, the weight ratio of a toner in a developer, that is, the toner concentration is preferably set at 75 to 99.9% by weight.

The electrophotographic developer according to the present invention, prepared as described above, can be used in copying machines, printers, FAXs, printing machines and the like, which use a digital system using a development system in which electrostatic latent images formed on a latent image holder having an organic photoconductive layer are reversely developed with a magnetic brush of a two-component developer having a toner and a carrier while a bias electric field is being impressed. The electrophotographic developer is also applicable to full-color machines and the like using an alternative electric field, in which when a development bias is impressed from a magnetic brush to an electrostatic latent image side, an AC bias is superimposed on a DC bias.

Hereinafter, the present invention will be described specifically by way of Examples and the like.

Example 1

52 mol of $Fe_2O_3$, 40 mol of $MnO_2$ and 8 mol of MgO were weighed, and pelletized by a roller compactor. The obtained pellet was calcined in a rotary sintering furnace under the conditions of the air atmosphere at 1,030° C.

The calcined pellet was coarsely pulverized by a dry-type bead mill; thereafter, water and 1.5 mol of $SrCO_3$ were added thereto, and pulverized by a wet-type bead mill for 6 hours; PVA as a binder component was added to the slurry so that the amount of PVA became 3.2% by weight to the slurry solid content; and a polycarboxylic acid-based dispersant was added thereto so that the viscosity of the slurry became 2 to 3 poises, to thus make a pulverized slurry. The solid content of the slurry at this time was 55% by weight, and $D_{50}$ of the slurry particle diameter was 1.82 μm.

The pulverized slurry thus obtained was granulated and dried by a spray drier, primarily sintered under the conditions of the air atmosphere at 700° C. using a rotary furnace. Then, the sintered material was held under the conditions of an oxygen concentration of 0.5% by volume at 1,130° C. for 4 hours using an electric furnace to carry out regular sintering. Thereafter, the sintered material was deagglomerated, and further classified to obtain a carrier core material composed of a ferrite particle.

Further, the obtained carrier core material composed of a ferrite particle was subjected to a surface oxidation treatment under the conditions of the air atmosphere at a surface oxidation treatment temperature of 520° C. using a rotary electric furnace to obtain a surface-oxidized carrier core material (ferrite particle).

Example 2

A carrier core material (ferrite particle) was obtained as in Example 1, except that 52 mol of $Fe_2O_3$, 45 mol of $MnO_2$ and 3 mol of MgO were weighed, and pelletized by a roller compactor, and 1.5 mol of $SrCO_3$ was added to the pulverized slurry in the regular granulation.

Example 3

A carrier core material (ferrite particle) was obtained as in Example 1, except that 52 mol of $Fe_2O_3$, 39 mol of $MnO_2$ and 9 mol of MgO were weighed, and pelletized by a roller compactor, and 1.5 mol of $SrCO_3$ was added to the pulverized slurry in the regular granulation.

Example 4

A carrier core material (ferrite particle) was obtained as in Example 1, except that 59 mol of $Fe_2O_3$, 38 mol of $MnO_2$ and 3 mol of MgO were weighed, and pelletized by a roller compactor, and 1.5 mol of $SrCO_3$ was added to the pulverized slurry in the regular granulation.

Example 5

A carrier core material (ferrite particle) was obtained as in Example 1, except that 50 mol of $Fe_2O_3$, 43 mol of $MnO_2$ and 6 mol of MgO were weighed, and pelletized by a roller compactor, and 1.5 mol of $SrCO_3$ was added to the pulverized slurry in the regular granulation.

Example 6

A carrier core material (ferrite particle) was obtained as in Example 1, except that 52 mol of $Fe_2O_3$, 40 mol of $MnO_2$ and 8 mol of MgO were weighed, and pelletized by a roller compactor, and 0.75 mol of $SrCO_3$ was added to the pulverized slurry in the regular granulation.

Example 7

A carrier core material (ferrite particle) was obtained as in Example 1, except that 52 mol of $Fe_2O_3$, 40 mol of $MnO_2$ and 8 mol of MgO were weighed, and pelletized by a roller compactor, and 2.5 mol of $SrCO_3$ was added to the pulverized slurry in the regular granulation.

Example 8

A carrier core material (ferrite particle) was obtained as in Example 1, except for altering the regular sintering temperature to 1,100° C.

Example 9

A carrier core material (ferrite particle) was obtained as in Example 1, except for altering the regular sintering temperature to 1,160° C.

Example 10

A carrier core material (ferrite particle) was obtained as in Example 1, except for altering the oxygen concentration in the regular sintering to 1.5% by volume.

Example 11

A carrier core material (ferrite particle) was obtained as in Example 1, except for altering the surface oxidation treatment temperature to 480° C.

Example 12

A carrier core material (ferrite particle) was obtained as in Example 1, except for altering the surface oxidation treatment temperature to 620° C.

Example 13

A carrier core material (ferrite particle) was obtained as in Example 1, except for altering the classification conditions in regulation of the particle size distribution to the classification conditions shown in Table 1.

Example 14

A carrier core material (ferrite particle) was obtained as in Example 1, except for altering the classification conditions in regulation of the particle size distribution to the classification conditions shown in Table 1.

Comparative Examples

Comparative Example 1

A carrier core material (ferrite particle) was obtained as in Example 1, except that 52 mol of $Fe_2O_3$ and 48 mol of $MnO_2$ were weighed, and pelletized by a roller compactor.

Comparative Example 2

A carrier core material (ferrite particle) was obtained as in Example 1, except that 52 mol of $Fe_2O_3$, 35 mol of $MnO_2$ and 15 mol of MgO were weighed, and pelletized by a roller compactor.

Comparative Example 3

A carrier core material (ferrite particle) was obtained as in Example 1, except that 52 mol of $Fe_2O_3$, 40 mol of $MnO_2$ and 8 mol of MgO were weighed, and pelletized by a roller compactor.

Comparative Example 4

A carrier core material (ferrite particle) was obtained as in Example 1, except that 52 mol of $Fe_2O_3$, 40 mol of $MnO_2$ and 8 mol of MgO were weighed, and pelletized by a roller compactor, and 4.5 mol of $SrCO_3$ was added to the pulverized slurry in the regular granulation.

Comparative Example 5

A carrier core material (ferrite particle) was obtained as in Example 1, except for altering the regular sintering temperature to 1,050° C.

Comparative Example 6

A carrier core material (ferrite particle) was obtained as in Example 1, except for altering the regular sintering temperature to 1,250° C.

Comparative Example 7

A carrier core material (ferrite particle) was obtained as in Example 1, except for altering the oxygen concentration in the regular sintering to 21% by volume (in the air atmosphere).

Formulation proportions (numbers of moles of raw materials prepared), calcination conditions (temperatures and atmospheres), conditions of the pulverized slurries and the regular granulations ($SrCO_3$ amounts, slurry solid contents and slurry particle diameters), primary sintering conditions (temperatures and atmospheres), regular sintering conditions (temperatures and atmospheres) and classification conditions (fine powder removal, coarse powder removal) in Examples 1 to 14 and Comparative Examples 1 to 7, are shown in Table 1. Chemical analyses, molar ratios of Mn/Mg, properties before the oxidation treatment (magnetizations, N/N resistivities, N/N charge amounts, H/H charge amounts) and X-ray diffractions before the surface oxidation treatment of the carrier core materials obtained in Examples 1 to 14 and Comparative Examples 1 to 7, are shown in Table 2.

Further, surface oxidation treatment temperatures, and properties after the surface oxidation treatment (average particle diameters, apparent densities, BET specific surface areas, magnetizations, N/N resistivities, N/N charge amounts, H/H charge amounts) in Examples 1 to 14 and Comparative Examples 1 to 7, are shown in Table 3; X-ray diffractions after the surface oxidation treatment, and chlorine elution amounts therein are shown in Table 4; and comparisons of X-ray analysis after the surface oxidation treatment therein are shown in Table 5. Further, distributions in the number and the average values of shape factors SF-2, and the presences/absences of $Mn^{3+}$ and $Mn^{4+}$ by XPS are shown in Table 6. Here, the measurement method of the charge amount shown in Table 3 was as described below. The measurement conditions under each environment of the resistivities and the charge amounts in Table 2 and Table 3 were as described below. The measurement methods of other items are as described above. The distributions in the number of SF-2, the average particle diameters, the BET specific surface areas, and the Cl elution amounts did not change before and after the surface oxidation treatment, therefore, these values only after the surface oxidation treatment are shown.

(The Charge Amount)

A sample (a carrier or a carrier core material) and a commercially available negatively chargeable toner used in full-color printers and having an average particle diameter of about 6 μm were weighed so that the toner concentration was 6.5% by weight (the toner weight was 3.25 g, and the carrier weight was 46.75 g). The weighed carrier and toner were exposed for 12 or more hours under each environment. Thereafter, the carrier and the toner were put in a 50-cc glass bottle, and stirred at a rotation frequency of 100 rpm for 30 min.

As a charge amount measuring apparatus, a magnet roll in which a magnet (magnetic flux density: 0.1 T) of a total of 8 poles of N poles and S poles alternately arranged on the inner side of an aluminum bare tube (hereinafter, sleeve) of a cylindrical shape of 31 mm in diameter and 76 mm in length, and a cylindrical electrode with a gap of 5.0 mm from the sleeve, were arranged in the outer circumference of the sleeve.

0.5 g of a developer was uniformly adhered on the sleeve, and thereafter, while the magnet roll, which was on the inner side, was being rotated at 100 rpm with the outer-side aluminum bare tube being fixed, a direct current voltage of 2,000 V was impressed for 60 sec between the outer electrode and the sleeve to transfer the toner to the outer-side electrode. At this time, an electrometer (an insulation-resistance tester, model: 6517A, made by Keithley Instrument Inc.) was connected to the cylindrical electrodes to measure the charge amount of the transferred toner.

After the elapse of 60 sec, the impressed voltage was shut off, and after the rotation of the magnet roll was stopped, the outer-side electrode was taken out and the weight of the toner having transferred to the electrode was measured.

The charge amount was calculated from the measured charge amount and the weight of the transferred toner.

"Under each environment" refers to the normal-temperature and normal-humidity (N/N) environment, and the high-temperature and high-humidity (H/H) environment, and the temperature and humidity conditions were as follows.

(The Temperature and Humidity Conditions)

The normal-temperature and normal-humidity (N/N) environment: a temperature of 20 to 25° C. and a relative humidity of 50 to 60%

The high-temperature and high-humidity (H/H) environment: a temperature of 30 to 35° C. and a relative humidity of 80 to 85%

TABLE 1

| | Composition (Molar Ratios for Preparation) | | | Calcination Conditions | | Conditions of Pulverized Slurry and Regular Granulation | | | Primary Sintering Conditions | |
|---|---|---|---|---|---|---|---|---|---|---|
| | $Fe_2O_3$ | $MnO_2$ | MgO | Calcination Temperature (° C.) | Calcination Atmosphere | $SrCO_3$ (mol) | Slurry Solid Content (wt %) | Slurry Particle Diameter (μm) | Primary Sintering Temperature (° C.) | Primary Sintering Atmosphere |
| Ex. 1 | 52 | 40 | 8 | 1030 | air atmosphere | 1.5 | 55 | 1.82 | 700 | air atmosphere |
| Ex. 2 | 52 | 45 | 3 | 1030 | air atmosphere | 1.5 | 55 | 1.93 | 700 | air atmosphere |
| Ex. 3 | 52 | 39 | 9 | 1030 | air atmosphere | 1.5 | 55 | 1.79 | 700 | air atmosphere |
| Ex. 4 | 59 | 38 | 3 | 1030 | air atmosphere | 1.5 | 55 | 1.87 | 700 | air atmosphere |
| Ex. 5 | 50 | 43 | 6 | 1030 | air atmosphere | 1.5 | 55 | 1.95 | 700 | air atmosphere |
| Ex. 6 | 52 | 40 | 8 | 1030 | air atmosphere | 0.75 | 55 | 1.85 | 700 | air atmosphere |
| Ex. 7 | 52 | 40 | 8 | 1030 | air atmosphere | 2.5 | 55 | 1.88 | 700 | air atmosphere |
| Ex. 8 | 52 | 40 | 8 | 1030 | air atmosphere | 1.5 | 55 | 1.82 | 700 | air atmosphere |
| Ex. 9 | 52 | 40 | 8 | 1030 | air atmosphere | 1.5 | 55 | 1.82 | 700 | air atmosphere |
| Ex. 10 | 52 | 40 | 8 | 1030 | air atmosphere | 1.5 | 55 | 1.82 | 700 | air atmosphere |
| Ex. 11 | 52 | 40 | 8 | 1030 | air atmosphere | 1.5 | 55 | 1.82 | 700 | air atmosphere |
| Ex. 12 | 52 | 40 | 8 | 1030 | air atmosphere | 1.5 | 55 | 1.82 | 700 | air atmosphere |
| Ex. 13 | 52 | 40 | 8 | 1030 | air atmosphere | 1.5 | 55 | 1.82 | 700 | air atmosphere |
| Ex. 14 | 52 | 40 | 8 | 1030 | air atmosphere | 1.5 | 55 | 1.82 | 700 | air atmosphere |
| Comp. Ex. 1 | 52 | 48 | 0 | 1030 | air atmosphere | 0 | 55 | 1.80 | 700 | air atmosphere |
| Comp. Ex. 2 | 52 | 35 | 15 | 1030 | air atmosphere | 0 | 55 | 1.76 | 700 | air atmosphere |
| Comp. Ex. 3 | 52 | 40 | 8 | 1030 | air atmosphere | 0 | 55 | 1.85 | 700 | air atmosphere |
| Comp. Ex. 4 | 52 | 40 | 8 | 1030 | air atmosphere | 4.5 | 55 | 1.96 | 700 | air atmosphere |
| Comp. Ex. 5 | 52 | 40 | 8 | 1030 | air atmosphere | 1.5 | 55 | 1.82 | 700 | air atmosphere |
| Comp. Ex. 6 | 52 | 40 | 8 | 1030 | air atmosphere | 1.5 | 55 | 1.82 | 700 | air atmosphere |
| Comp. Ex. 7 | 52 | 40 | 8 | 1030 | air atmosphere | 1.5 | 55 | 1.82 | 700 | air atmosphere |

| | Regular Sintering Conditions | | Classification Conditions | |
|---|---|---|---|---|
| | Sintering Temperature (° C.) | Oxygen Concentration (vol %) | Fine Powder Removal Rotation Frequency (rpm) | Coarse Powder Removal Rotation Frequency (rpm) |
| Ex. 1 | 1130 | 0.5 | standard rotation frequency | standard rotation frequency × 0.45 times |
| Ex. 2 | 1130 | 0.5 | standard rotation frequency | standard rotation frequency × 0.45 times |
| Ex. 3 | 1130 | 0.5 | standard rotation frequency | standard rotation frequency × 0.45 times |
| Ex. 4 | 1130 | 0.5 | standard rotation frequency | standard rotation frequency × 0.45 times |
| Ex. 5 | 1130 | 0.5 | standard rotation frequency | standard rotation frequency × 0.45 times |
| Ex. 6 | 1130 | 0.5 | standard rotation frequency | standard rotation frequency × 0.45 times |
| Ex. 7 | 1130 | 0.5 | standard rotation frequency | standard rotation frequency × 0.45 times |
| Ex. 8 | 1100 | 0.5 | standard rotation frequency | standard rotation frequency × 0.45 times |
| Ex. 9 | 1160 | 0.5 | standard rotation frequency | standard rotation frequency × 0.45 times |
| Ex. 10 | 1130 | 1.5 | standard rotation frequency | standard rotation frequency × 0.45 times |
| Ex. 11 | 1130 | 0.5 | standard rotation frequency | standard rotation frequency × 0.45 times |
| Ex. 12 | 1130 | 0.5 | standard rotation frequency | standard rotation frequency × 0.45 times |
| Ex. 13 | 1130 | 0.5 | standard rotation frequency × 0.9 times | standard rotation frequency × 0.3 times |
| Ex. 14 | 1130 | 0.5 | standard rotation frequency × 1.25 times | standard rotation frequency × 0.75 times |
| Comp. Ex. 1 | 1130 | 0.5 | standard rotation frequency | standard rotation frequency × 0.45 times |
| Comp. Ex. 2 | 1130 | 0.5 | standard rotation frequency | standard rotation frequency × 0.45 times |
| Comp. Ex. 3 | 1130 | 0.5 | standard rotation frequency | standard rotation frequency × 0.45 times |
| Comp. Ex. 4 | 1130 | 0.5 | standard rotation frequency | standard rotation frequency × 0.45 times |
| Comp. Ex. 5 | 1050 | 0.5 | standard rotation frequency | standard rotation frequency × 0.45 times |
| Comp. Ex. 6 | 1250 | 0.5 | standard rotation frequency | standard rotation frequency × 0.45 times |
| Comp. Ex. 7 | 1130 | 21 | standard rotation frequency | standard rotation frequency × 0.45 times |

TABLE 2

| | Chemical Analysis (ICP) (wt %) | | | | Molecular ratio of | Properties Before Surface Oxidation Treatment | | | | X-Ray Diffraction (Before Surface Oxidation Treatment) | | | | |
|---|---|---|---|---|---|---|---|---|---|---|---|---|---|---|
| | Fe | Mn | Mg | Sr | Mn/Mg | Magnetization ($Am^2/kg$) | N/N Resistivity (Ω) | N/N Charge Amount (μC/g) | H/H Charge Amount (μC/g) | Half Width Value W11 of the (311) Plane Peak | Half Width Value W12 of the (622) Plane Peak | Peak Position P1 of the (311) Plane Peak | Presence of $Fe_2O_3$ | Presence of $Mn^{3+}$ and $Mn^{4+}$ |
| Ex. 1 | 49.75 | 18.63 | 1.63 | 1.13 | 5.06 | 58.4 | $4.2 \times 10^7$ | −30.34 | −27.27 | 0.1299 | 0.2776 | 40.9248 | absent | absent |
| Ex. 2 | 49.31 | 20.87 | 0.62 | 1.12 | 14.92 | 62.4 | $3.7 \times 10^7$ | −27.16 | −24.34 | 0.1236 | 0.2632 | 40.8912 | absent | absent |
| Ex. 3 | 50.13 | 18.43 | 1.90 | 1.11 | 4.29 | 57.7 | $6.5 \times 10^7$ | −30.83 | −27.59 | 0.1267 | 0.2702 | 40.9431 | absent | absent |
| Ex. 4 | 53.17 | 16.86 | 0.58 | 1.04 | 12.86 | 64.9 | $1.8 \times 10^7$ | −27.67 | −23.83 | 0.1254 | 0.2651 | 40.9011 | absent | absent |
| Ex. 5 | 48.87 | 20.68 | 1.27 | 1.16 | 7.20 | 58.7 | $1.5 \times 10^7$ | −28.75 | −25.57 | 0.1276 | 0.2719 | 40.9113 | absent | absent |
| Ex. 6 | 50.29 | 19.08 | 1.69 | 0.56 | 4.99 | 57.1 | $2.1 \times 10^7$ | −26.73 | −23.91 | 0.1175 | 0.2534 | 40.9278 | absent | absent |
| Ex. 7 | 49.67 | 18.49 | 1.67 | 1.88 | 4.90 | 58.1 | $2.3 \times 10^8$ | −33.75 | −30.57 | 0.1259 | 0.1762 | 40.9177 | absent | absent |
| Ex. 8 | 50.05 | 18.89 | 1.65 | 1.16 | 5.06 | 55.2 | $1.1 \times 10^7$ | −28.54 | −25.71 | 0.1401 | 0.2992 | 40.8891 | absent | absent |
| Ex. 9 | 49.78 | 18.79 | 1.68 | 1.12 | 4.95 | 58.9 | $7.6 \times 10^7$ | −33.13 | −30.52 | 0.1181 | 0.2526 | 40.9346 | absent | absent |
| Ex. 10 | 49.91 | 18.88 | 1.67 | 1.11 | 5.00 | 55.4 | $8.8 \times 10^7$ | −26.83 | −23.55 | 0.1343 | 0.2846 | 40.9268 | absent | absent |
| Ex. 11 | 49.75 | 18.63 | 1.63 | 1.13 | 5.06 | 58.4 | $4.2 \times 10^7$ | −30.34 | −27.27 | 0.1299 | 0.2776 | 40.9248 | absent | absent |
| Ex. 12 | 49.75 | 18.63 | 1.63 | 1.13 | 5.06 | 58.4 | $4.2 \times 10^7$ | −30.34 | −27.27 | 0.1299 | 0.2776 | 40.9248 | absent | absent |
| Ex. 13 | 49.75 | 18.63 | 1.63 | 1.13 | 5.06 | 58.3 | $8.9 \times 10^7$ | −35.29 | −32.79 | 0.1293 | 0.2751 | 40.9256 | absent | absent |
| Ex. 14 | 49.75 | 18.63 | 1.63 | 1.13 | 5.06 | 58.6 | $6.1 \times 10^7$ | −27.91 | −24.33 | 0.1282 | 0.2735 | 40.9237 | absent | absent |
| Comp. Ex. 1 | 49.52 | 22.54 | — | — | — | 65.5 | unmeasurable (low resistivity) | −14.45 | −10.13 | 0.1011 | 0.2516 | 40.8986 | absent | absent |
| Comp. Ex. 2 | 51.08 | 16.82 | 3.27 | — | 2.28 | 54.2 | $9.7 \times 10^6$ | −19.26 | −16.54 | 0.1138 | 0.2461 | 40.8761 | absent | absent |
| Comp. Ex. 3 | 50.81 | 19.23 | 1.71 | — | 4.97 | 59.0 | $7.5 \times 10^6$ | −22.14 | −18.76 | 0.1222 | 0.2708 | 40.918 | absent | absent |
| Comp. Ex. 4 | 48.62 | 18.61 | 1.67 | 3.29 | 4.93 | 47.1 | $6.2 \times 10^8$ | −16.38 | −11.19 | 0.1389 | 0.3312 | 40.9147 | absent | absent |
| Comp. Ex. 5 | 50.11 | 18.89 | 1.69 | 1.11 | 4.94 | 49.8 | $2.7 \times 10^7$ | −18.47 | −14.65 | 0.1801 | 0.3521 | 40.8769 | present | slightly present ($MnO_2$) |
| Comp. Ex. 6 | 49.98 | 19.02 | 1.66 | 1.12 | 5.07 | 58.6 | $5.8 \times 10^8$ | −33.82 | −29.98 | 0.1012 | 0.2331 | 40.9415 | absent | absent |
| Comp. Ex. 7 | 49.76 | 18.99 | 1.67 | 1.14 | 5.03 | 48.6 | $8.8 \times 10^8$ | −20.75 | −17.51 | 0.1201 | 0.1712 | 40.9802 | absent | slightly present ($Mn_2O_3$) |

TABLE 3

| | Surface | Properties After Surface Oxidation Treatment | | | | | | |
|---|---|---|---|---|---|---|---|---|
| | Oxidation Treatment Temperature (° C.) | Average Particle Diameter (μm) | Apparent Density ($g/cm^3$) | BET Specific Surface Area ($m^2/g$) | Magnetization ($Am^2/kg$) | N/N Resistivity (Ω) | N/N Charge Amount (μC/g) | H/H Charge Amount (μC/g) |
| Example 1 | 520 | 25.82 | 2.11 | 0.1812 | 55.8 | $9.7 \times 10^7$ | −29.43 | −26.87 |
| Example 2 | 520 | 24.32 | 2.09 | 0.1757 | 58.3 | $8.2 \times 10^7$ | −26.65 | −23.74 |
| Example 3 | 520 | 25.02 | 2.1 | 0.1996 | 53.4 | $1.8 \times 10^8$ | −29.38 | −26.47 |
| Example 4 | 520 | 25.41 | 2.08 | 0.1739 | 61.3 | $6.4 \times 10^7$ | −26.56 | −22.38 |
| Example 5 | 520 | 25.66 | 2.09 | 0.1965 | 55.0 | $6.1 \times 10^7$ | −27.83 | −24.56 |
| Example 6 | 520 | 24.78 | 2.13 | 0.1935 | 54.7 | $7.5 \times 10^7$ | −25.37 | −22.83 |
| Example 7 | 520 | 24.98 | 2.07 | 0.2187 | 54.1 | $4.1 \times 10^8$ | −32.57 | −29.75 |
| Example 8 | 520 | 24.67 | 2.06 | 0.2013 | 52.1 | $6.8 \times 10^7$ | −27.45 | −24.62 |
| Example 9 | 520 | 25.87 | 2.04 | 0.1705 | 53.1 | $1.8 \times 10^8$ | −32.09 | −29.25 |
| Example 10 | 520 | 25.14 | 2.08 | 0.1873 | 50.3 | $2.5 \times 10^7$ | −25.38 | −22.05 |
| Example 11 | 480 | 25.82 | 2.11 | 0.1856 | 56.7 | $7.8 \times 10^7$ | −30.11 | −26.89 |
| Example 12 | 620 | 25.82 | 2.11 | 0.1781 | 51.1 | $9.2 \times 10^7$ | −28.95 | −26.44 |
| Example 13 | 520 | 31.67 | 2.16 | 0.1521 | 56.2 | $1.9 \times 10^8$ | −33.97 | −31.09 |
| Example 14 | 520 | 22.38 | 2.02 | 0.2176 | 53.5 | $8.9 \times 10^7$ | −26.52 | −22.83 |
| Comparative Example 1 | 520 | 26.17 | 2.11 | 0.1251 | 61.3 | $7.7 \times 10^6$ | −10.13 | −7.56 |
| Comparative Example 2 | 520 | 25.89 | 2.04 | 0.1488 | 48.9 | $3.2 \times 10^7$ | −15.17 | −11.94 |
| Comparative Example 3 | 520 | 25.42 | 2.01 | 0.1411 | 55.1 | $7.2 \times 10^6$ | −18.95 | −14.61 |
| Comparative Example 4 | 520 | 25.54 | 2.03 | 0.3176 | 43.1 | $8.5 \times 10^8$ | −15.94 | −10.04 |

TABLE 3-continued

| | Surface | Properties After Surface Oxidation Treatment | | | | | | |
|---|---|---|---|---|---|---|---|---|
| | Oxidation Treatment Temperature (° C.) | Average Particle Diameter (μm) | Apparent Density (g/cm$^3$) | BET Specific Surface Area (m$^2$/g) | Magnetization (Am$^2$/kg) | N/N Resistivity (Ω) | N/N Charge Amount (μC/g) | H/H Charge Amount (μC/g) |
| Comparative Example 5 | 520 | 24.98 | 1.89 | 0.2849 | 44.1 | $5.8 \times 10^7$ | −12.53 | −10.12 |
| Comparative Example 6 | 520 | 25.33 | 1.98 | 0.1218 | 56.3 | $7.7 \times 10^8$ | −32.41 | −27.68 |
| Comparative Example 7 | 520 | 25.2 | 2.1 | 0.1923 | 48.1 | $1.1 \times 10^9$ | −20.56 | −17.41 |

TABLE 4

| | X-Ray Diffraction (After Surface Oxidation Treatment) | | | | | | | | |
|---|---|---|---|---|---|---|---|---|---|
| | Sr-Ferrite (wt %) | Sr—Fe Compound (wt %) | Sr Ferrite/All Sr—Fe Oxides | Half Width Value W21 of the (311) Plane Peak | Half Width Value W22 of the (622) Plane Peak | Peak Position P2 of the (311) Plane Peak | Presence of $Fe_2O_3$ | Presence of $Mn^{3+}$ and $Mn^{4+}$ | Cl Elution Amount (ppm) |
| Ex. 1 | 2.7 | 4.5 | 0.38 | 0.139 | 0.1725 | 40.9677 | absent | absent | 58 |
| Ex. 2 | 2.3 | 5.3 | 0.30 | 0.1321 | 0.1637 | 40.9314 | absent | absent | 56 |
| Ex. 3 | 3.1 | 4.1 | 0.43 | 0.1357 | 0.1682 | 40.9862 | absent | absent | 50 |
| Ex. 4 | 1.2 | 5.8 | 0.17 | 0.1352 | 0.165 | 40.9445 | absent | absent | 38 |
| Ex. 5 | 0.7 | 6.6 | 0.10 | 0.134 | 0.1692 | 40.9537 | absent | absent | 61 |
| Ex. 6 | 0.5 | 0.2 | 0.71 | 0.1368 | 0.1576 | 40.9721 | absent | absent | 23 |
| Ex. 7 | 4.9 | 6.4 | 0.43 | 0.1341 | 0.1762 | 40.9616 | absent | absent | 79 |
| Ex. 8 | 1.8 | 5.5 | 0.25 | 0.1436 | 0.1859 | 40.9333 | absent | absent | 73 |
| Ex. 9 | 3.4 | 3.7 | 0.48 | 0.1502 | 0.1571 | 40.9782 | absent | absent | 38 |
| Ex. 10 | 4.9 | 2.3 | 0.68 | 0.1439 | 0.1765 | 40.97 | absent | absent | 51 |
| Ex. 11 | 2.5 | 4.4 | 0.36 | 0.1539 | 0.2484 | 40.9333 | absent | absent | 57 |
| Ex. 12 | 3 | 4.1 | 0.42 | 0.1916 | 0.102 | 41.071 | absent | absent | 54 |
| Ex. 13 | 2.8 | 4.5 | 0.38 | 0.1385 | 0.1706 | 40.9682 | absent | absent | 52 |
| Ex. 14 | 2.6 | 5.1 | 0.34 | 0.1373 | 0.1702 | 40.9673 | absent | absent | 58 |
| Comp. Ex. 1 | — | — | — | 0.1082 | 0.1562 | 40.9429 | absent | absent | 18 |
| Comp. Ex. 2 | — | — | — | 0.1219 | 0.1527 | 40.9187 | absent | absent | 23 |
| Comp. Ex. 3 | — | — | — | 0.1309 | 0.1687 | 40.9612 | absent | absent | 22 |
| Comp. Ex. 4 | 7.7 | 2.5 | 0.75 | 0.1488 | 0.2062 | 40.9142 | absent | absent | 256 |
| Comp. Ex. 5 | 0.1 | 6.7 | 0.01 | 0.1918 | 0.2041 | 40.9207 | present | slightly present ($MnO_2$) | 183 |
| Comp. Ex. 6 | 5.2 | 1.2 | 0.81 | 0.1113 | 0.1482 | 40.9867 | absent | absent | 13 |
| Comp. Ex. 7 | 7.4 | 0 | 1.00 | 0.1474 | 0.1822 | 40.9798 | absent | slightly present ($Mn_2O_3$) | 164 |

TABLE 5

| | X-ray diffraction (Comparison Between Before and After Surface Oxidation Treatment) | | |
|---|---|---|---|
| | WS1 | WS2 | P2-P1 |
| Example 1 | 2.137 | 1.241 | 0.0429 |
| Example 2 | 2.129 | 1.239 | 0.0402 |
| Example 3 | 2.133 | 1.239 | 0.0431 |
| Example 4 | 2.114 | 1.220 | 0.0434 |
| Example 5 | 2.131 | 1.263 | 0.0424 |
| Example 6 | 2.157 | 1.152 | 0.0443 |
| Example 7 | 2.249 | 1.314 | 0.0439 |
| Example 8 | 2.136 | 1.295 | 0.0442 |
| Example 9 | 2.139 | 1.046 | 0.0436 |
| Example 10 | 2.119 | 1.227 | 0.0432 |
| Example 11 | 2.137 | 1.614 | 0.0085 |
| Example 12 | 2.137 | 0.532 | 0.1462 |
| Example 13 | 2.128 | 1.232 | 0.0426 |
| Example 14 | 2.133 | 1.240 | 0.0436 |
| Comparative Example 1 | 2.489 | 1.444 | 0.0443 |

TABLE 5-continued

| | X-ray diffraction (Comparison Between Before and After Surface Oxidation Treatment) | | |
|---|---|---|---|
| | WS1 | WS2 | P2-P1 |
| Comparative Example 2 | 2.163 | 1.253 | 0.0426 |
| Comparative Example 3 | 2.216 | 1.289 | 0.0432 |
| Comparative Example 4 | 2.384 | 1.386 | −0.0005 |
| Comparative Example 5 | 1.955 | 1.064 | 0.0438 |
| Comparative Example 6 | 2.303 | 1.332 | 0.0452 |
| Comparative Example 7 | 1.425 | 1.236 | −0.0004 |

TABLE 6

| | Shape Factor SF-2 (%) | | | | | | | Average | Presence of $Mn^{+3}$, $Mn^{+4}$ by XPS | |
|---|---|---|---|---|---|---|---|---|---|---|
| | ≥130 | ≥125 and <130 | ≥120 and <125 | ≥115 and <120 | ≥110 and <115 | ≥105 and <110 | ≥100 and <105 | Value of Shape Factor SF-2 | Before Surface Oxidation Treatment | After Surface Oxidation Treatment |
| Example 1 | 0.80 | 0.50 | 0.93 | 2.07 | 5.17 | 20.47 | 70.07 | 105.8 | absent | present |
| Example 2 | 0.67 | 1.03 | 1.80 | 1.20 | 2.80 | 30.30 | 62.20 | 106.0 | absent | present |
| Example 3 | 1.50 | 1.17 | 3.57 | 6.60 | 8.97 | 37.97 | 40.23 | 108.1 | absent | present |
| Example 4 | 0.87 | 0.90 | 2.53 | 5.13 | 8.40 | 34.60 | 47.57 | 107.4 | absent | present |
| Example 5 | 1.20 | 1.00 | 1.50 | 3.47 | 4.03 | 9.87 | 78.93 | 105.9 | absent | present |
| Example 6 | 2.67 | 3.30 | 3.00 | 2.90 | 5.13 | 23.20 | 59.80 | 107.7 | absent | present |
| Example 7 | 0.77 | 0.70 | 1.87 | 2.43 | 5.57 | 18.47 | 70.20 | 106.1 | absent | present |
| Example 8 | 1.71 | 1.02 | 1.42 | 3.17 | 7.24 | 38.24 | 47.20 | 107.3 | absent | present |
| Example 9 | 0.70 | 1.47 | 1.80 | 2.07 | 4.23 | 31.07 | 58.67 | 106.4 | absent | present |
| Example 10 | 0.87 | 2.13 | 2.30 | 2.57 | 5.93 | 31.83 | 54.37 | 106.9 | absent | present |
| Example 11 | 0.80 | 0.50 | 0.93 | 2.07 | 5.17 | 20.47 | 70.07 | 105.8 | absent | slightly present |
| Example 12 | 0.80 | 0.50 | 0.93 | 2.07 | 5.17 | 20.47 | 70.07 | 105.8 | absent | present |
| Example 13 | 1.00 | 0.67 | 1.20 | 1.60 | 4.53 | 30.00 | 61.00 | 106.1 | absent | present |
| Example 14 | 1.03 | 0.50 | 0.93 | 2.60 | 5.40 | 23.80 | 65.73 | 106.3 | absent | present |
| Comparative Example 1 | 1.17 | 0.40 | 1.00 | 2.83 | 5.53 | 24.53 | 64.53 | 106.2 | absent | present |
| Comparative Example 2 | 0.73 | 0.57 | 1.43 | 3.73 | 7.63 | 28.17 | 57.73 | 106.6 | absent | present |
| Comparative Example 3 | 1.13 | 0.67 | 1.10 | 2.50 | 5.47 | 24.73 | 64.40 | 106.2 | absent | present |
| Comparative Example 4 | 0.90 | 1.03 | 3.73 | 5.47 | 4.63 | 32.17 | 52.07 | 107.2 | absent | present |
| Comparative Example 5 | 2.63 | 1.57 | 1.90 | 4.27 | 9.30 | 68.00 | 12.33 | 109.0 | slightly present | present |
| Comparative Example 6 | 2.30 | 2.13 | 3.07 | 7.67 | 22.00 | 54.10 | 8.73 | 110.4 | absent | present |
| Comparative Example 7 | 1.60 | 1.63 | 2.85 | 5.82 | 13.59 | 39.15 | 35.37 | 108.5 | present | present |

Any of the core material particles in Examples 1 to 14 contained Sr, and not only had a uniform surface property, had a large BET specific surface area, and a high charging capability, but also was excellent in the environmental dependency. Carrying out the surface oxidation treatment and relaxing the internal stress of the core material particle makes the core material particle exhibiting little cracking and chipping in use as a carrier, thus making the core material particle suitable as a carrier for electrophotography.

By contrast, since Comparative Examples 1 to 3 did not contain Sr, the core material particle not only became one which had a small BET specific surface area and which could not be coated sufficiently with a resin, but also became one which exhibited a low charging capability. Comparative Example 4 had a large content of Sr and a low magnetization. Since the core material particle thereof had a large BET specific surface area, the core material particle not only became one which had a large Cl elution amount and exhibited a low charging capability, but also became one having a large environmental dependency. Since Comparative Example 5 had a too low sintering temperature, the BET specific surface area became large and the core material particle became one exhibiting a large environmental dependency of the charging capability. The core material particle further became one which had a low magnetization and whose carrier scattering was apprehended. Since Comparative Example 6 had a too high sintering temperature, the core material particle not only became one which had a small BET specific surface area and which could not be coated sufficiently with a resin, but also became one whose projections became large and which consequently had a nonuniform surface property and had the apprehension of occurrence of white spots in use as a core material of a carrier for electrophotography. Since Comparative Example 7 was sintered in the air atmosphere, much of a Sr ferrite was formed, and the core material particle became one which had a low magnetization and whose carrier scattering was apprehended. Further, the core material particle not only became one which had a low charging capability, but also resulted in a core material particle whose whole surface had large unevenness to give the nonuniform surface property.

Example 15

An acryl-modified silicone resin (KR-9706, made by Shin-Etsu Silicones Co., Ltd.) and a carbon black (Ketjen Black EC600JD, made by Lion Corp.) were applied as a coating resin onto the carrier core material particle of Example 1 by a universal mixing stirrer. At this time, the resin solution used was prepared by weighing the resin so that the solid content of the resin became 2.5% by weight with respect to the carrier core material, adding 7.5% by weight of the carbon black with respect to the solid content of the resin, adding a solvent in which toluene and MEK were mixed in 3:1 so that the solid content of the resin became 20% by weight, pre-dispersing the mixture for 3 min by a homogenizer (T65D ULTRA-TURRAX, made by IKA-Werke GmbH & Co. KG), and thereafter dispersing the pre-dispersed dispersion by a vertical bead mill for 5 min. After the resin was applied, the resin was dried under stirring for 3 hours in a heat exchange-type stirring heater set at 200° C. in order to eliminate the volatile content completely. Thereafter, the aggregated particle was deagglomerated to obtain a resin-coated carrier.

Example 16

A silicone resin (KR-350, made by Shin-Etsu Silicones Co., Ltd.), an aluminum-based catalyst (CAT-AC, made by Dow Corning Toray Co., Ltd.) and a carbon black (Ketjen Black EC600JD, made by Lion Corp.) were applied as a coating resin onto the carrier core material particle of Example 1 by a universal mixing stirrer. At this time, the resin solution used was prepared by weighing the resin so that the solid content of the resin became 2.5% by weight with respect to the carrier core material, adding 2% by weight of the aluminum-based catalyst and 10% by weight of the carbon black with respect to the solid content of the resin, adding toluene so that the solid content of the resin became 20% by weight, pre-dispersing the mixture for 3 min by a homogenizer (T65D ULTRA-TURRAX, made by IKA-Werke GmbH & Co. KG), and thereafter dispersing the pre-dispersed dispersion by a vertical bead mill for 5 min. After the resin was applied, the resin was dried for 3 hours in a hot air drier set at 250° C. in order to eliminate the volatile content completely. Thereafter, the aggregated particle was deagglomerated to obtain a resin-coated carrier.

Example 17

An acryl resin (Dianal BR-80, made by Mitsubishi Rayon Co., Ltd.) was applied as a coating resin onto the carrier core material particle of Example 1 by a universal mixing stirrer. At this time, the resin solution used was prepared by weighing the resin so that the solid content of the resin became 2.5% by weight with respect to the carrier core material, and adding toluene so that the solid content of the resin became 10% by weight. Here, since the resin was powdery, the resin solution was put in hot water so that the temperature of the resin solution became 50° C., to completely dissolve the resin powder. After the resin was applied, the resin was dried under stirring for 3 hours in a heat exchange-type stirring heater set at 145° C. in order to eliminate the volatile content completely, to obtain a resin-coated carrier.

The charge amount measurement results after resin coating in Examples 15 to 17 are shown in Table 7. The measurement method of the charge amount was as described above.

TABLE 7

| | Charge Amount (μC/g) | |
|---|---|---|
| | N/N | H/H |
| Example 15 | −60.19 | −57.65 |
| Example 16 | −42.57 | −40.97 |
| Example 17 | −79.2 | −73.72 |

As is clear from the results in Table 7, any of Examples 15 to 17 in which the ferrite carrier core material according to the present invention was coated with the each resin gave a ferrite carrier for an electrophotographic developer, which ferrite carrier had a sufficient charging property in the N/N environment and the H/H environment.

INDUSTRIAL APPLICABILITY

The ferrite carrier core material for an electrophotographic developer according to the present invention has a larger BET specific surface area than conventional core material particles because having fine unevenness present on the surface although having a nearly spherical particle shape in spite of having a reasonably small particle diameter, has an excellent charging property, hardly causes carrier scattering due to cracking and chipping of the core material, and has a prolonged life. Then, the electrophotographic developer comprising a toner and the ferrite carrier obtained by coating the ferrite carrier core material with a resin has a high charge amount, is prevented from carrier scattering in actual machines and continuously gives high-quality printed matters. The manufacturing methods according to the present invention can provide the ferrite carrier core material and the ferrite carrier stably and productively.

Therefore, the present invention can be broadly used particularly in the fields of the full-color machines requiring a high image quality, high-speed machines requiring reliability and durability in image maintenance.

The invention claimed is:

1. A ferrite carrier core material for an electrophotographic developer, wherein:

(1) a ferrite composition contains 0.5 to 2.5% by weight of Sr; and a presence amount of Sr—Fe oxides satisfies the following conditional expression:

$$0<\text{a weight of a Sr ferrite/a total weight of all Sr—Fe oxides}\leq 0.8 \quad \text{[Expression 1]}$$

provided that the total weight of all Sr—Fe oxides=the Sr ferrite+the Sr—Fe oxides other than the Sr ferrite;

(2) in the distribution in the number of the shape factor SF-2, the number of particles of 100 or more and less than 105 is 40% by number or more; that of 105 or more and less than 110 is 5 to 40% by number; that of 110 or more and less than 120 is 20% by number or less; that of 120 or more is 10% by number or less; and that of 130 or more is 5% by number or less;

(3) the BET specific surface area is 0.15 to 0.30 $m^2/g$;

(4) the average particle diameter $D_{50}$ in measurement by a laser diffraction particle size distribution analyzer is 20 to 35 μm; and (5) the magnetization by VSM measurement when a magnetic field of $1K\cdot1000/4\pi\cdot A/m$ is impressed is 50 to 65 $Am^2/kg$.

2. The ferrite carrier core material for an electrophotographic developer according to claim 1, comprising 15 to 22% by weight of Mn, 0.5 to 3% by weight of Mg, and 45 to 55% by weight of Fe.

3. The ferrite carrier core material for an electrophotographic developer according to claim 1, having a surface oxide film formed thereon.

4. The ferrite carrier core material for an electrophotographic developer according to claim 1, having a Cl elution amount using a pH-4 standard solution of 0.1 to 150 ppm.

5. The ferrite carrier core material for an electrophotographic developer according to claim 1, having a resistivity at 100 V at a 1-mm gap of $1\times10^7$ to $5\times10^8\Omega$.

6. A ferrite carrier for an electrophotographic developer, wherein a surface of a ferrite carrier core material according to claim 1 is coated with a resin.

7. A method for manufacturing a ferrite carrier core material for an electrophotographic developer, the method comprising:

pulverizing, mixing and calcining a ferrite raw material;

thereafter again pulverizing the calcined material;

adding a Sr compound to the pulverized material, mixing and granulating the material;

and initially sintering the obtained granulated material at 600 to 800° C.;

thereafter sintering the sintered material under an atmosphere of an oxygen concentration of 0.1 to 5% by volume at 1,100 to 1,200° C.; and then deagglomerating and classifying the sintered material;

thereby forming the ferrite carrier core material of claim 1.

8. The method for manufacturing a ferrite carrier core material for an electrophotographic developer according to claim 7, wherein the ferrite raw material comprises an Fe compound and additionally a Mn compound and a Mg compound.

9. The method for manufacturing a ferrite carrier core material for an electrophotographic developer according to claim 7, the method comprising subjecting the ferrite carrier core material to a surface oxidizing treatment after the deagglomeration and the classification.

10. A method for manufacturing a ferrite carrier for an electrophotographic developer, the method comprising coating a ferrite carrier core material, obtained by a manufacturing method according to claim 7, on a surface thereof with a resin.

11. An electrophotographic developer comprising a ferrite carrier according to claim 6 and a toner.

12. The electrophotographic developer according to claim 11, wherein the electrophotographic developer is a refill developer.

* * * * *